US007498923B2

(12) United States Patent
Iversen

(10) Patent No.: US 7,498,923 B2
(45) Date of Patent: Mar. 3, 2009

(54) FAST ACTING, LOW COST, HIGH POWER TRANSFER SWITCH

(76) Inventor: Arthur H. Iversen, 89 Inlets Blvd., Nokomis, FL (US) 34275

( * ) Notice: Subject to any disclaimer, the term of this patent is extended or adjusted under 35 U.S.C. 154(b) by 194 days.

(21) Appl. No.: 11/204,464

(22) Filed: Aug. 16, 2005

(65) Prior Publication Data

US 2006/0049027 A1 Mar. 9, 2006

Related U.S. Application Data

(60) Provisional application No. 60/607,878, filed on Sep. 8, 2004.

(51) Int. Cl.
*H01H 85/38* (2006.01)

(52) U.S. Cl. ..... 337/165; 337/273; 337/296; 200/61.08

(58) Field of Classification Search ..... 361/165; 200/61.08; 337/165, 273, 296
See application file for complete search history.

(56) References Cited

U.S. PATENT DOCUMENTS

| | | | | |
|---|---|---|---|---|
| 2,903,534 A | | 5/1959 | Bleakney | 200/61.08 |
| 2,929,892 A | | 3/1960 | Blomgren | 200/61 |
| 2,931,874 A | | 4/1960 | Leaman | 337/406 |
| 3,117,194 A | | 1/1964 | Stresau | 200/61 |
| 3,238,321 A | | 3/1966 | Lawwill | 200/61 |
| 3,260,810 A | | 7/1966 | Alston | 200/61 |
| 3,269,987 A | | 8/1966 | Alston | 200/61 |
| 3,277,255 A | | 10/1966 | Mattsson | 200/61.08 |
| 3,361,064 A | * | 1/1968 | Johnston et al. | 102/202.3 |
| 3,641,289 A | | 2/1972 | Dokopoulos | 200/61 |
| 3,793,501 A | | 2/1974 | Stonestrom | 200/61.08 |
| 3,803,374 A | | 4/1974 | Delgendre | 200/61.08 |
| 3,848,099 A | | 11/1974 | Christian | 200/61.08 |
| 3,848,100 A | | 11/1974 | Kozorezov | 200/61.08 |
| 3,873,786 A | | 3/1975 | Lagofun | 200/61.08 |
| 3,915,236 A | * | 10/1975 | Stichling | 169/61 |
| 3,932,717 A | | 1/1976 | Dike | 200/61.08 |
| 3,958,206 A | | 5/1976 | Klint | 337/406 |
| 3,962,605 A | | 6/1976 | Thaler | 361/54 |
| 4,176,385 A | | 11/1979 | Dethlefsen | 361/58 |
| 4,224,487 A | | 9/1980 | Simonsen | 200/61.08 |
| 4,311,890 A | * | 1/1982 | Schroder | 200/61.08 |

(Continued)

OTHER PUBLICATIONS

C. H. Flurscheim, Power Circuit Breaker Theory and Design, 1982, pp. 390-392, IEE Power Engineering Series 1, Peter Peregrinus Ltd., London, UK.

*Primary Examiner*—Anatoly Vortman
(74) *Attorney, Agent, or Firm*—Armstrong Teasdale LLP

(57) ABSTRACT

A transfer switch comprising a housing and a strip of metal enclosed in the housing, each end extending through the housing as a first connection. At least one first contact is integral to the metal strip. At least one second contact within the housing extends through the housing wall for a second electrical connection. At least one first section of the metal strip for severing and at least one second section of the metal strip having the properties of a hinge for pivoting. At least one exothermic source in the proximity of the first section that upon ignition severs the metal strip at the first section, and causes at least one segment of the severed metal strip to be propelled about the second section comprising the hinge, whereupon the first electrical contact is propelled to join the second electrical contact.

35 Claims, 11 Drawing Sheets

U.S. PATENT DOCUMENTS

| | | | | |
|---|---|---|---|---|
| 4,319,527 | A | 3/1982 | Niemeyer | 102/314 |
| 4,339,638 | A | 7/1982 | Lascelles | 200/52 R |
| 4,405,867 | A | 9/1983 | Moakler | 307/64 |
| 4,417,519 | A | 11/1983 | Lutz | 102/263 |
| 4,471,402 | A | 9/1984 | Cunningham | 361/125 |
| 4,479,105 | A | 10/1984 | Banes | 337/401 |
| 4,490,707 | A | 12/1984 | O'Leary | 337/6 |
| 4,538,133 | A | 8/1985 | Pflanz | 337/4 |
| 4,680,434 | A | 7/1987 | Skogmo | 200/61.08 |
| 4,920,446 | A | 4/1990 | Pflanz | 361/93.7 |
| 5,535,842 | A * | 7/1996 | Richter et al. | 180/279 |
| 5,793,275 | A | 8/1998 | Iversen | 337/273 |
| 5,990,572 | A * | 11/1999 | Yasukuni et al. | 307/10.1 |
| 6,194,988 | B1 * | 2/2001 | Yamaguchi et al. | 337/157 |
| 6,388,554 | B1 * | 5/2002 | Yamaguchi | 337/401 |
| 6,411,190 | B1 * | 6/2002 | Yamaguchi et al. | 337/401 |
| 6,483,420 | B1 * | 11/2002 | Takahashi et al. | 337/401 |
| 6,577,216 | B2 | 6/2003 | Turner | 335/2 |
| 6,590,481 | B2 | 7/2003 | Turner | 335/68 |
| 7,239,225 | B2 * | 7/2007 | Tirmizi | 337/30 |

* cited by examiner

C-C

D-D

D-D

FAST ACTING, LOW COST, HIGH POWER TRANSFER SWITCH

RELATED APPLICATIONS

This application claims priority in part to Iversen, "Fast Acting, Low Cost, High Power Transfer Switch", U.S. Provisional Patent Application Ser. No. 60/607,878, filed on Sep. 8, 2004.

BACKGROUND OF THE INVENTION

1. Field of the Invention

The present invention relates to electrical transfer switches used, for example, to disconnect from a first circuit and connect to a second circuit, and is used in the transmission and distribution of power over the grid and within industrial and commercial facilities. It addresses the need for very fast power transfers in emergency situations such as power failures and malfunctions, and to short circuit or arcing conditions to reduce electrocutions, burns and injury due to arc flash, explosions and noise, and damage to equipment and infrastructure.

2. Related Art

Conventional power transfer switches generally comprise two types, electromechanical and solid state. Solid state power transfer switches require 2-4 ms (milliseconds) to effect a circuit transfer. Electromechanical power transfer switches typically require 4 to 10 cycles (67 to 167 ms). Electromechanical devices such as power transfer switches are almost universally used. The Bureau of Labor Statistics reports that there is a yearly average of 290 fatalities from electrocution, more that 4,000 disabling injuries and 3,600 non-disabling injuries. A major cause is the slow response of electromechanical safety devices. Solid state power transfer switches are very expensive and simply blow protective fuses when the short circuit current rise times are too fast. The proposed transfer switch is expected to have circuit transfer time of a few hundred microseconds (e.g. 0.2 ms). This is ten times faster than solid state power transfer switches and over three hundred times faster than electromechanical power transfer switches. This fast transfer time reduces personnel exposure to the long time constant of potentially fatal current flows. Furthermore, arcs remain, for "a few milliseconds" at the arcing points before developing and expanding out to endanger personnel. The few hundred microsecond transfer time into a load dump can prevent the arc from enlarging thereby minimizing or eliminating burns and injuries due to arc flash, explosions and noise as well as damage to equipment. Fast interception of the arc current can reduce the probability of electrocution.

SUMMARY OF THE INVENTION

The present invention comprises a high speed (~0.2 ms) power transfer switch. It is a low cost one time device for use in emergency situations such as power failures, arcing conditions, short circuits and equipment failures. It also serves to reduce personnel exposure to electrocution, and injuries due to arc burns and explosions. It is the fast response time of over three hundred times faster than electromechanical transfer switches that minimizes the energy of short circuits and arcs.

There is described a transfer switch comprising a housing and a current carrying strip of metal enclosed in the housing, each end of which electrically extends through the housing as a first electrical connection. There being at least one first metal electrical contact electrically and mechanically integral to the metal strip. There being at least one second metal electrical contact within the housing and extending through the housing wall to make available a second electrical connection. There being at least one first section of the metal strip for severing upon predetermined conditions, and at least one second section of the metal strip, distanced from the first section, having the properties of a hinge for pivoting. There further being at least one exothermic source in the proximity of the first section that upon ignition severs the metal strip at the first section, and causes at least one segment of the severed metal strip to be propelled about the second section comprising the hinge, whereupon the first electrical contact is propelled to join the second electrical contact thereby forming the second electrical connection.

1) The transfer switch of the present invention provides the fastest power transfer time of any available technology.

2) The transfer switch of the present invention enables improved personnel safety.

3) The transfer switch of the present invention reduces equipment and infrastructure damage under short circuit and arcing conditions.

4) The transfer switch of the present invention is low cost, compact, and being substantially passive is essentially maintenance free.

5) The transfer switch of the present invention enables second power sources to be virtually instantly connected to sensitive loads such as computers and life support equipment.

FAST ACTING, LOW COST, HIGH POWER TRANSFER SWITCH

There is described a transfer switch which may be configured with multiple second contacts each of which may be connected to an independent circuit. Upon activation of the switch, a predetermined second contact is selected for connection and upon being connected thereby establishes a new circuit configuration. The switch is a one time device that is removed from the circuit and replaced with one as was originally in the circuit in order to return to the original circuit configuration.

Figure 1:
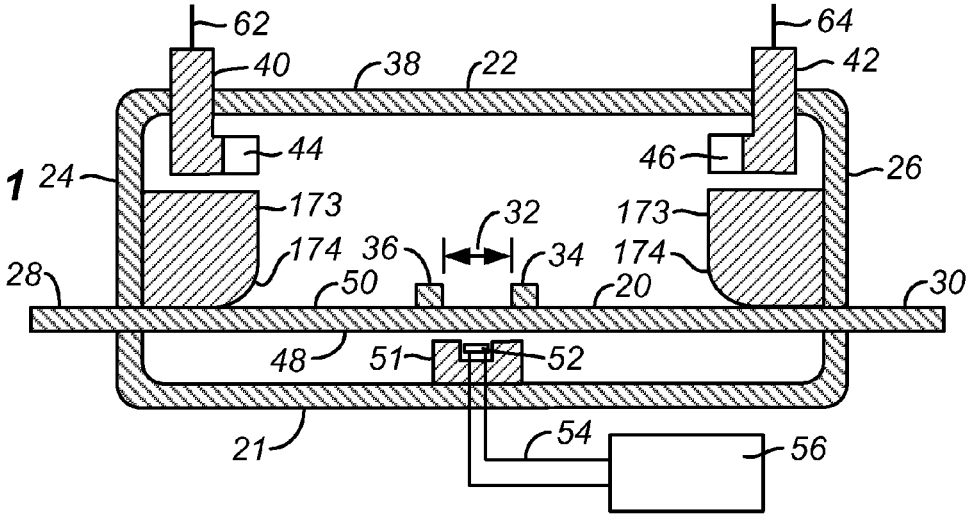
FIG. 1 is a side cross section view of a transfer switch with two first electrical contacts integral with the metal current carrying strip and an exothermic source intermediate the electrical contacts, and two second electrical contacts extending through the housing wall.

Referring now to FIG. 1, which illustrates the basic construction of the transfer switch 21. An elongated strip or strip of conductive material 20, preferably a metal such as copper extends through hollow housing 22. Housing 22 is made of an electrically insulating material such as epoxy-fiberglass, ceramic or other material having predetermined electrical insulation and strength characteristics. Strip 20 extends through two walls of housing 22, here shown as opposing walls 24 and 26. Strip 20 external to housing 22 at wall 24 is designated as the input contact 28 and strip 20 external to housing 22 at wall 26 is designated the output contact 30. Preferably positioned approximately on either side of the internal midpoint of strip 20 and spaced apart 32 are first contacts 34 and 36 which are electrically and mechanically integral with strip 20. Only one contact, such as 36, may be employed, but two, 34 and 36, are shown for greater versatility. Contact 34 is designated the output first contact and contact 36 is designated the input first contact. Housing 22 has mounted through wall 38 second input contact 40 and second output contact 42. Second contacts 40 and 42 extend from inside housing 22 through wall 38 and externally beyond wall 38 for connection to second input circuit 62 and second output circuit 64. Means for making electrical contact between first input contact 36 and second input contact 40 may be by way of fingers 44 for blade contact 36 to engage in the manner of well-known finger and blade contacts. In like manner, fingers 46 may be provided in second output contact 42 for blade contact 34 to engage.

In proximity to surface 48 of strip 20, and opposing surface 50 of strip 20 with contacts 34, 36 mounted thereon, an exothermic source 52, for example, pyrotechnics, mounted in holder 51, is positioned intermediate between contacts 34, 36. Holder 51 is preferably of a high temperature material such as alumina ceramic. Source 52 generally extends less than the spacing 32 between contacts 34, 36. That is, it preferably does not extend under contacts 34, 36. Exothermic ignition means may comprise ignition wire 54 passing through exothermic source 52 which in turn is connected to electrical power source 56. Upon receiving a trigger signal, power source 56 sends an electrical signal, here a surge of current through wire 54 which in turn passes through source 52. A segment of wire 54, within source 52, which has a high resistively, heats up and ignites source 52.

Figure 2:
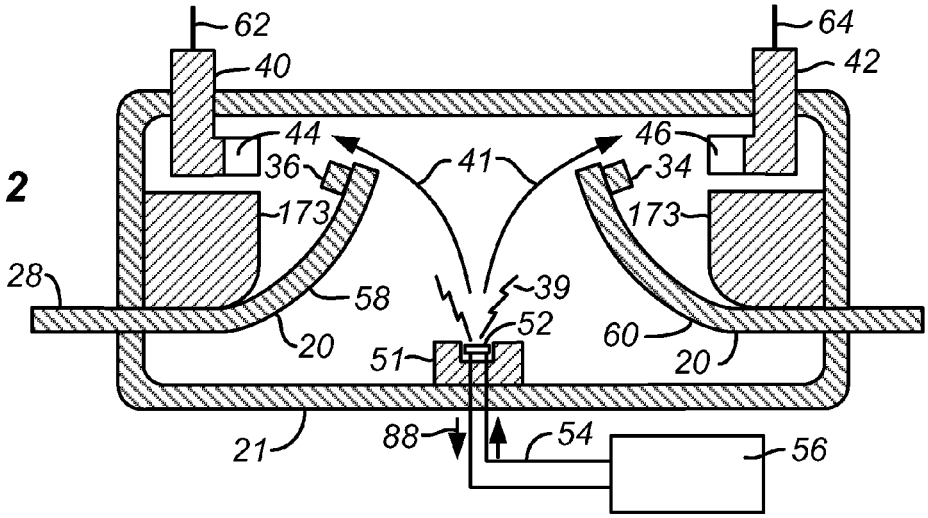
FIG. 2 is a side cross section view of the bifurcation of the metal strip into two segments and their propulsion away from each other toward the second contacts by virtue of ignition of the exothermic source.

Referring now to FIG. 2, shown is exothermic source 52 having ignited 39 and severed strip 20 in the region of 32

(FIG. 1) and thereafter propelling 41 the now two segments 58 and 60 of strip 20 toward respective second contacts 40 and 42.

Figure 3:
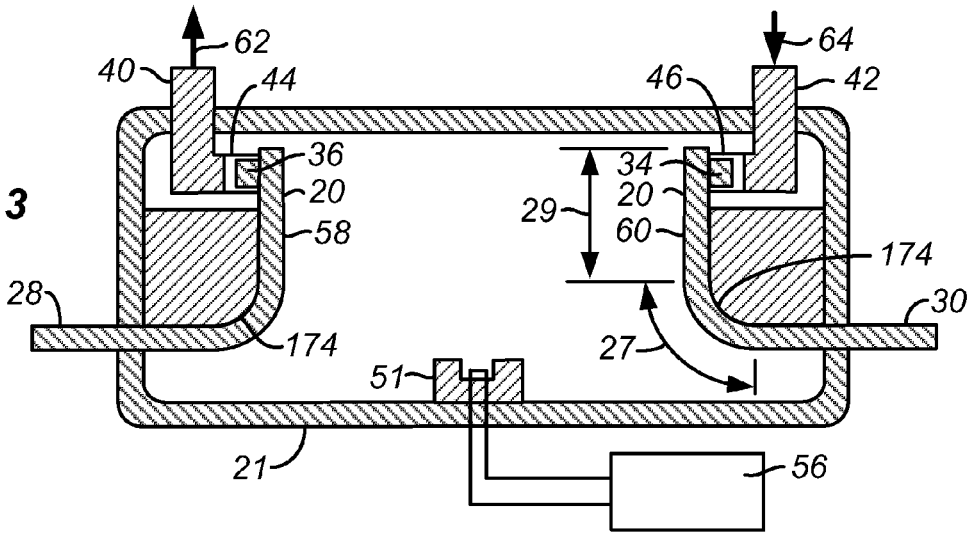
FIG. 3 is a side cross section view of the transfer switch after the first contacts on the two segments of the metal strip have engaged the second contacts thereby completing the second electrical connection.

Referring now to FIG. 3, shown is completion of the circuit transfer with input first contact 36 on strip 20 segment 58 having connectively engaged second input contact 40 by virtue of finger 44 and blade 36 means. In like manner, output first blade contact 34 on segment 60 of strip 20 has connectively engaged finger contacts 46 on second output contact 42. Thus, the input contact 28 has been disconnected from output contact 30 and has been connected to contact 40 attached to second input circuit 62. In like manner, output contact 30 has been disconnected from input contact 28 and has been connected to second output contact 42 which is connected to second output circuit 64 which may, for example, be a second power source.

Strip 20 segments 58, 60 have a first section 29 which incorporates first contacts 34, 36 and a second section 27 which acts as a hinge for segments 58, 60 as they bend around curved surfaces 174 while propelling contacts 34, 36 on the first sections toward engagement with contacts 44, 46.

Figure 4:
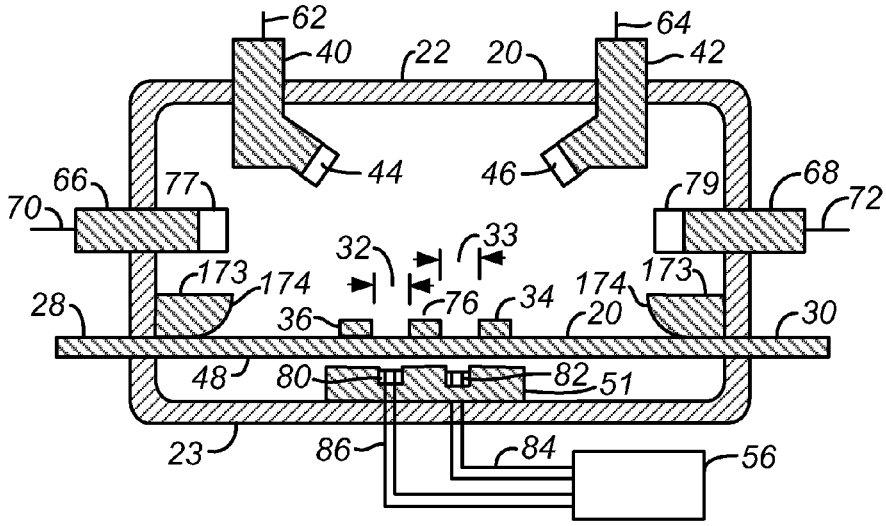
FIG. 4 is a side cross section view of a transfer switch comprising three first contacts integral with the metal conducting strip with exothermic sources between adjoining contacts, and two each second and third contacts for the input and output.

Referring now to FIG. 4, shown is a further preferred embodiment of the transfer switch 23 employing multiple input and output contacts. Though three first contacts and four second contacts are shown and suffice for illustration; more than two each may be employed for input and output.

Housing 22 has mounted second and third input contacts 40 and 66, and second and third output contacts 42 and 68. Strip 20 has three first contacts mechanically and electrically integral with it; first input contact 36, first joint contact 76 and first output contact 34. Intermediate 32 contacts 36 and 76 and adjoining the opposing surface 48 of strip 20 exothermic source 80 (similar to 52, FIG. 1) is positioned. In like manner, intermediate 33 contacts 76 and 34 and adjoining the opposing surface 48 of strip 20, exothermic source 82 is positioned (similar to 52 in FIG. 1). Independent ignition wires 86 and 84 pass respectively through sources 80 and 82 (as in FIG. 1, wires 54 and source 52). Current source 56 now selectively controls the ignition of either source 80 or source 82. The four second contacts comprise second input contact 40 and third input contact 66, and second output contact 42 and third output contact 68.

Figure 5:
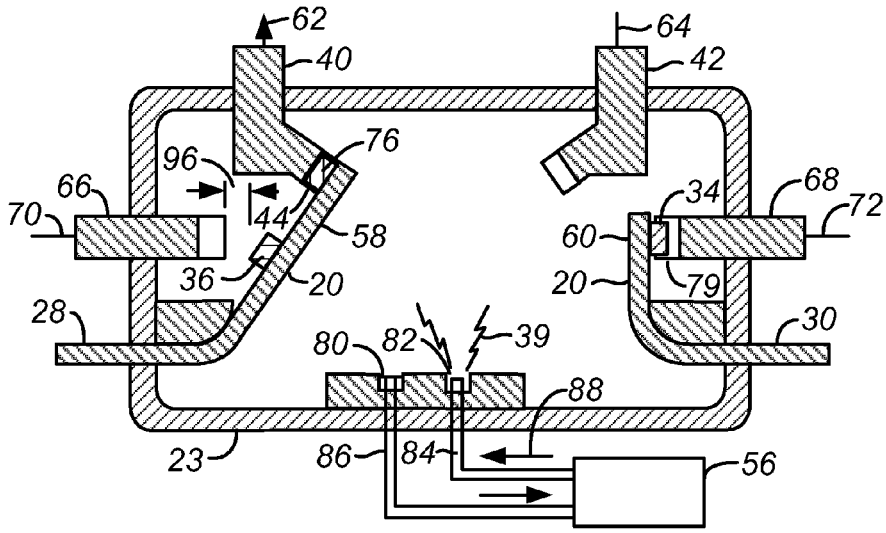
FIG. 5 is a side cross section view of FIG. 4 illustrating the first set of two possible connection options for the input and output contacts.

Referring now to FIG. 5, a signal is given to current source 56 to connect input connector 28 to second input connector 40 and second input circuit 62, and to connect output connector 30 to third output connector 68 and third output circuit 72. To this end, a current surge 88 passes through wires 84 and ignites 39 source 82 severing connector 20 in region 33 (FIG. 4) and propelling strip 20 segment 60 containing blade contact 34 into finger contacts 79 of third output contact 68. In like manner, strip 20 segment 58 containing joint contact blade 76 is caused to engage fingers 44 of second input contact 40 that is connected to second input circuit 62.

Figure 6:
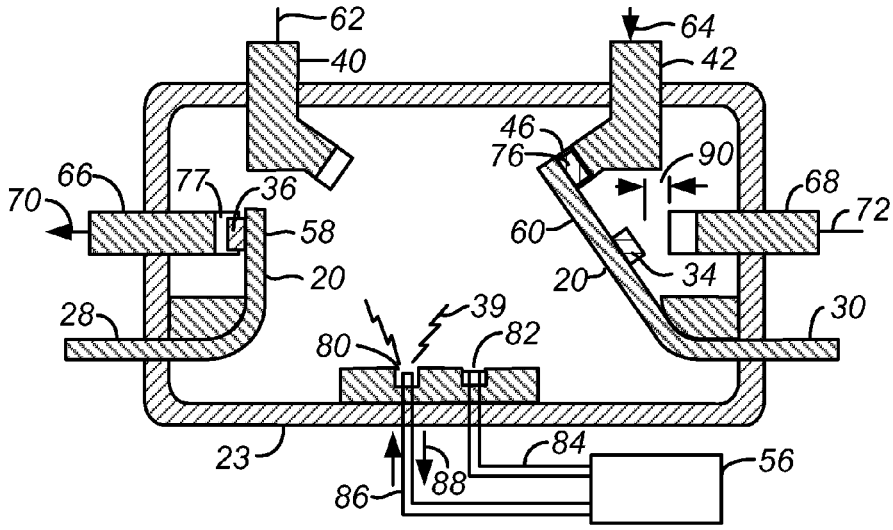
FIG. 6 is a side cross section view of FIG. 4 illustrating the second set of possible connection options for the input and output contacts.

Referring now to FIG. 6, a signal is sent from current source 56 to ignite 39 source 80 to switch the input 28 to third input connector 66 and its third input circuit 70, and to switch the output 30 to second output connector 42 and its second output circuit 64. Circuits within current source 56 trigger a device, such as MOSFET or IGBT, which sends current 88 through wires 86 to source 80 which ignites 39 it whereupon strip 20 is severed 32 between contacts 74 and 76. It should be noted that contact 68 is spaced back 90 from contact 34 thereby insuring that contact 34 does not approach too closely or engage contact 68. Other than different contact connections and cutting source what transpires is substantially the same as in FIG. 5. In like manner contact 36 is spaced 96 away from contact 66 in FIG. 5.

Figure 7:
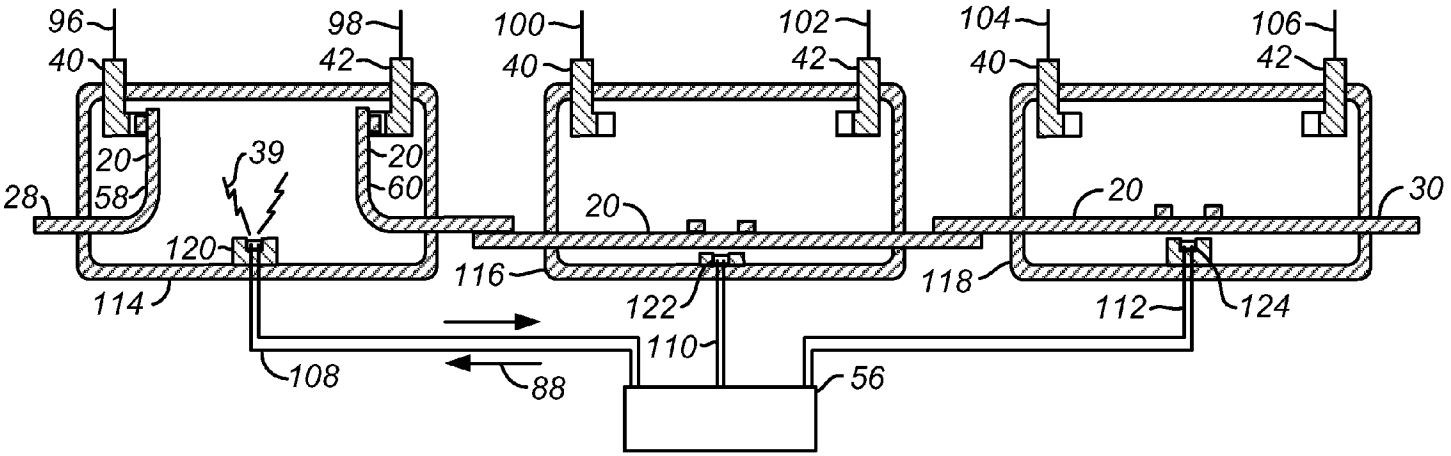
FIG. 7 is a side cross section view of a multiple function transfer switch illustrating a series connection of multiple transfer switches to affect multiple second electrical connection choices; all controlled by a single electrical power source.

Referring now to FIG. 7, shown is the series connection of strips 20 of three transfer switches 114, 116 and 118. Respective second input and output leads 40 and 42 of each switch are connected to different circuits 96, 98,100, 102, 104 and 106 as shown. Current source 56 has connected to it ignition wires 108, 110 and 112 from each of the three transfer switches 114, 116 and 118 as shown. Any pair of circuits, 96 and 98, or 100 and 102, or 104 and 106 may be selectively engaged by igniting the appropriate exothermic source, 120 or 122 or 124. Shown in FIG. 7 is source 120 ignited 39 by command of current 88 from source 56 through wires 108 thereby connecting the input connector 28 to circuit 96, and the output connector 30 to circuit 98. In like manner, source 122 or source 124 may be ignited to connect to circuits 100 and 102, and to circuits 104 and 106 to input 28 and output 30, respectively.

A more complex series of circuit connections may be obtained by igniting two or all three sources simultaneously. If two sources 120 and 122 are ignited, input connector 28 connects to circuit 96, circuit 98 connects to circuit 100, and circuit 102 connects to output connector 30. If all three sources 120, 122 124 are ignited, the connections would be 28 to 96, 98 to 100, 102 to 104 and 106 to 30. In this manner 7 combinations of circuit connections may be obtained. Though three switches 114, 116 and 118 are shown connected in series, a greater number may be so connected in series in the manner shown.

The switch configuration of FIG. 7 may be employed as a unique interrupting device. When all three cutting sources 120, 122 and 124 are ignited, connections 28 to 96, 98 to 100, 102 to 104 and 106 to 30 are made as previously described. Connections 98 to 100 and 102 to 104 are not connected to external circuits and are thus floating. Connections 98 and 100 are tied together through strip 20 as are 102 and 104. To cope with over voltage buildup that can occur at circuit interruption, the flash-over to floating contacts 98, 100 and 102, 104 that may occur can be dissipated by tying 98, 100 and 102, 104 to external spark gaps and/or loads where the flash-over energy is dissipated. Contacts 96 and 106 may be left floating or also may be connected to spark gaps and/or loads, or to second circuit configurations.

Referring again to FIG. 2, when igniting exothermic source 52, ignition wire 54 has a high resistance segment incorporated into or near source 52. Upon heating up of the resistive segment of the ignition wire to a suitable temperature source 52 ignites. Because of the resistance of the wire, there is a small time lag to reach temperature. A much faster method is to employ an arc. Arc temperatures can range from 5,000 degrees Kelvin to 15,000 degrees Kelvin, more than sufficient to ignite any exothermic material.

Figure 9:
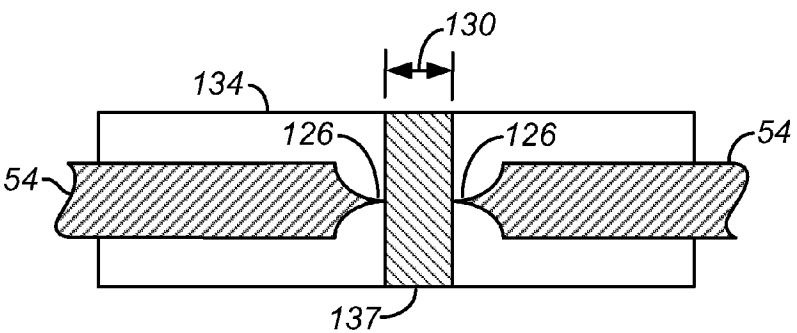
FIG. 9 is a top down cross sectional view of FIG. 8 illustrating sharp edged strips to facilitate arcing.
Figure 8:
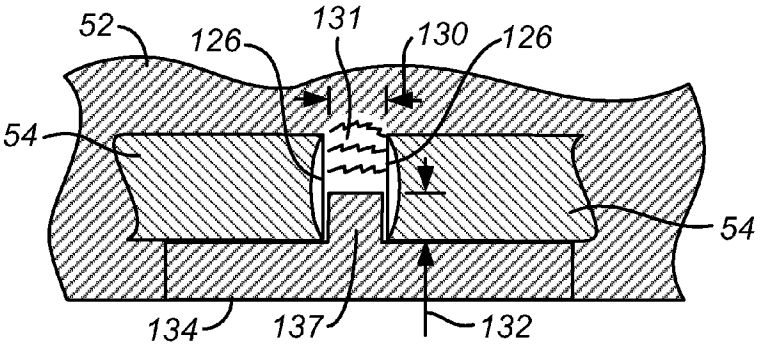
FIG. 8 is a partial side cross section view illustrating the use of arcing means for rapid ignition of the exothermic source.

Referring now to FIGS. 8 and 9, FIG. 8 is a cross section view showing ignition wire 54, which now may be copper, having been cut in two such that sharp edges 126 are formed. FIG. 9 is a partial top down view of sharp edges 126 of wire 54 without showing exothermic source 52. The sharp edges 126 are separated a small distance 130, which for example, may be from 0.1 mm to 3 mm, or may be greater or smaller depending upon voltages available from the power supply. Ignition wire 54, which may, for example, be 1 mm in diameter may have both sharp ends precisely positioned with respect to each other by mounting them for example, on a ceramic or other insulating plate 134 having a small raised portion 137 at approximately mid-point to provide the desired spacing 130 between opposing sharp edges 126. Height 132 of raised portion 137, may, for example, be half that of wire 54 diameter thereby exposing half the height of the sharp edges 126 to each other. The exposed sharp edges 126 become the source of the arc 131 when an electrical signal, here a suitable voltage, is applied by an electrical power source, not shown, across the gap 130 between edges 126. Wires 54 may be held in precise axial alignment by clamping, gluing or other suitable means. If the exothermic material 52 is cast over wire 54 and plate 134 it may be desirable to cover gap 130 with a form fitting cover, such as a small strip of adhesive tape to keep the gap open for consistent arc striking. However, with a sufficiently high voltage this is not needed. If the exothermic material is pre-cast, a groove approximately corresponding to the wire 54 diameter may be provided thereby insuring gap 130 remains open and not filled with exothermic material 52. By employing gated MOSFET or IGBTs, arc ignition voltages across gap 130 may be generated in microseconds or less. To improve reliability of exothermic ignition, both a resistance wire, as described in FIGS. 1 to 3, and the above described arcing means may be employed.

Figure 10:
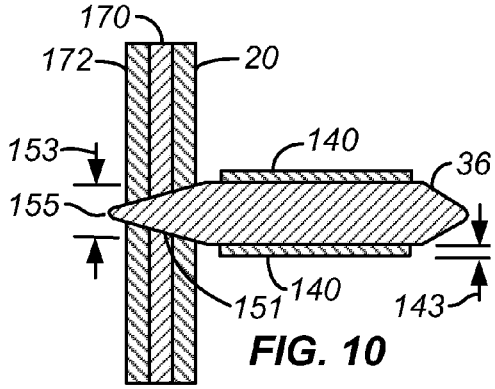
FIG. 10 is an end on cross section view of a laminated metal strip with a finger configuration electrical contact mechanically and electrically embedded in the strip.

Referring now to FIG. 10, shown is a method for mechanically and electrically joining in an integral manner contact 36 to superimposed strip strips 20, 170 and 172. Contact 36 is tapered 151 at its base. Strips 20, 170 and 172 are provided with progressively narrower slots 153 into which the tapered 151 portion of contact 36 part way slips into. The slot in strip 20 is wider than the slot in strip 170, and the slot in strip 170 is wider than the slot in strip 172. Insulation 200 (FIG. 19) that is near slots 153 is removed. Superimposed strips 20, 170, 172 with contact 36 resting in slots 153 are placed in a swaging fixture. Contact 36 may be of full hard copper and strips 20, 170, 172 may be quarter hard copper which is much softer. The swaging fixture is placed in a press and contact 36 pressed deeper into slots 153 thereby creating an interference fit that deforms (swages) the softer superimposed strips 20, 170, 172 copper into contact 36. This creates a substantially continuous and tight mechanical and excellent electrical contact between the mating surfaces of contact 36 and strips 20, 170 and 172. The protruding tip 155 of contact 36 taper 151 may be swaged in the manner of a rivet either during or subsequent to the swaging of strips 20, 170, 172 to taper 151 thereby firmly locking contact 36 to strips 20, 170, 172.

At high current levels, for example, in the many hundreds of amperes, contact resistance between electrical contacts can cause significant heating with possible failure under adverse conditions. The conventional solution is to employ bolts to make low resistance connections. Insertion connections, structures, such as sliding finger and blade, and rod and sleeve contacts may be employed. To keep contact resistance low, large forces are required at high current levels as there are in essence only point or line contacts. A design is proposed to enable low contact resistance, suitable for high currents, to be obtained with a novel slide-in design, such as finger and blade, or rod and sleeve. Finger and blade contacts are in common usage and are herein called finger and blade. The practicality of the proposed design rests on the fact that this is a single use device, that is, it only has to work once.

Figure 11:
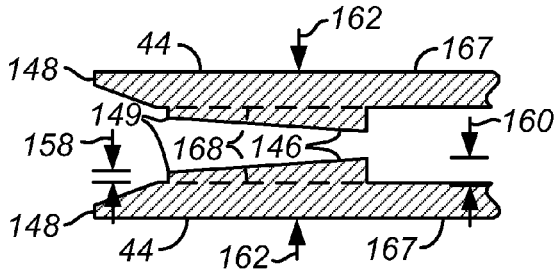
FIG. 11 is an end on cross section view of a pair of mating electrical contact blades, with contact protrusions, for the finger contact of FIG. 10.

Referring again to FIG. 10, blade 36, connected to strip 20, comprising a strip such as copper and shown here as having a rectangular shape but which may have any suitable shape such as circular. Blade 36 has deposited on at least one of opposing surfaces a layer of compressible conductive material 140 of thickness 143, preferably of metal, for example, silver, copper or tin. The compressible metal 140 may have a predetermined porosity to give it a sponge like resiliency while retaining good electrical and mechanical characteristics. For a given metal 140 material and compressibility, the degree of compression of metal 140 is determined by the inward force 162, as shown in FIG. 11, applied by fingers 44. The thickness 143 of the deposit of silver, or other suitable metal, may, for example, range from 0.02 mm to 6 mm with a preferred thickness range of 0.1 mm to 1.0 mm. Methods for controlled deposition of compressible metal 140 on blade 36 include: electroplating, thermal spraying, flame spraying, arc spraying, plasma spraying, and thermo-compression bonding of powdered metal in a binder. Further treatment, such as sintering and/or compressive pressure, at an elevated temperature, to improve adhesion and further control porosity, and which may be done in a controlled atmosphere, may be employed. The compressibility of the deposited metal layer is measured by, for example, its deformation under predetermined pressure. Compression may range from 0.01 mm to 3 mm and is dictated largely by density, porosity and degree of the sintering of the metal particles. Compressible metal layer 140 is shown on blade contact 36. Alternatively, metal layer 140 may be deposited on fingers 44.

Metals are normally characterized by "hardness". Machinery's Handbook, 27$^{th}$ Edition, Industrial Press states " . . . hardness scales . . . are based on the assumption that the metal tested is homogeneous to a depth several times that of the indentation". The deposited metal layer of the present invention is not homogeneous and is characterized by variable porosity, random interstices between adjacent metal particles, and the relatively light degree of sintering of adjoining metal particles in order to achieve the desired compressibility. These properties are random in nature and a different effective hardness would be measured at different points on the deposited metal layer surface making a hardness difficult to specify. The method of metal deposition will also have an impact on the above characteristics, such as electroplating versus flame spraying. The deposited metal layer is characterized by compressibility, and toughness, that is, its resistance to flaking and tearing as the first and second contacts are in the process of engaging at high velocity. This indicates the need for the more general designation of "predetermined compressibility".

Referring now to FIG. 11, shown are opposing fingers 44 as are employed in finger-and-blade contacts. Fingers 44 may be constructed with knife edge ridges 146, rising above surface 168 of fingers 44 and are of generally triangular cross section, or other suitable shape, such as rounded protrusions, for engaging the compressible metal deposit 140 on blade 36. Ridges 146 may commence with a small height 158 and progressively become larger, to height 160, away from the finger insertion lips 148. The leading edge 149 of ridges 146 at 148 may come to a rounded line having a sharp edge as in the bow of a boat. Ridges 146 may be formed by stamping, embossing, EDM technique or other suitable method. The length of ridges 146 need be only slightly longer than that (150 FIG. 12) of the compressible silver or other metal plating 140 as it substantially comprises the electrical contact area. With a predetermined compressibility and porosity of metal 140, a further design is to omit ridges 146 and employing a flat surface 168 of fingers 44 against the flat surface of metal 140 with a suitable applied force 162. Ridges 146 are shown on fingers 44. Alternatively ridges 146 may be prepared on blade 36.

Figure 12:
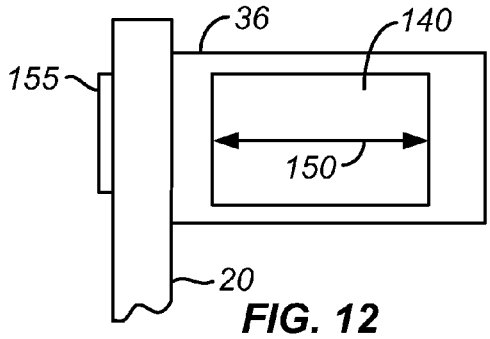
FIG. 12 is a side view of FIG. 10.

Referring now to FIG. 12, shown is a side view of blade 36 connected to strip 20 showing the compressible material 140 deposit.

Figure 13:
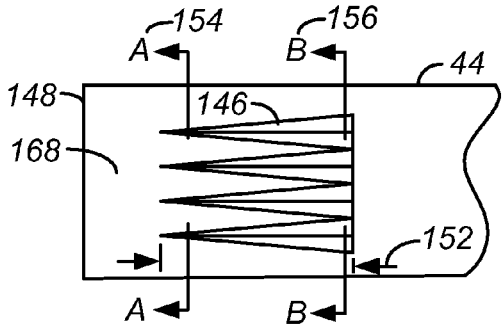
FIG. 13 is a side view of FIG. 11 illustrating contact protrusions.

Referring now to FIG. 13, shown is a top-down view of a finger 44 illustrating construction of ridges 146. Cross section A-A 154 is at the small height end of ridges 146 and cross section B-B 156 is at the large height end of ridges 146

Figure 14:
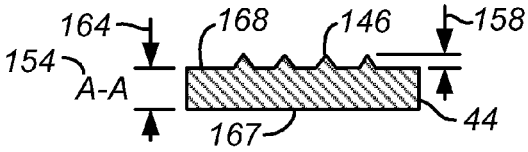
FIG. 14 is an end on cross section view A-A of FIG. 13 illustrating the start of the contact protrusions.
Figure 15:
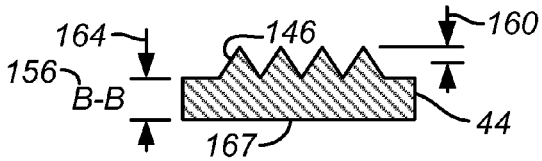
FIG. 15 is an end on cross section view B-B of FIG. 13 illustrating the end of contact protrusion height.

Referring now to FIG. 14, cross section A-A 154 (FIG. 12) of fingers 44 illustrates the low height 158 of ridges 146 at finger insertion lips 148 progressively becoming higher 160 as shown in FIG. 15, which is cross section B-B 156 of FIG. 13.

Figure 16:
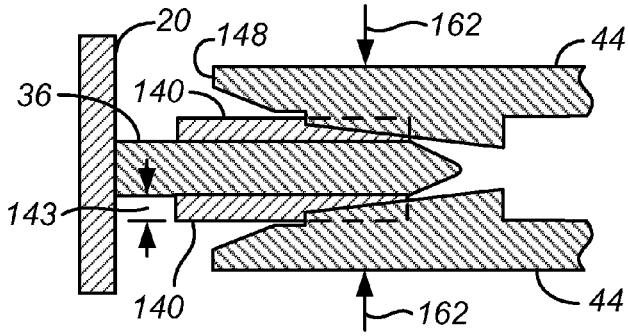
FIG. 16 is an end on cross section view of the finger of FIG. 10 mating with the blades of FIG. 11 to form the second electrical connection.

Referring now to FIG. 16, as blade 36 engages fingers 44, the small height 158 (FIGS. 11, 14) of the ridges 146 at the finger insertion lips 148 commence to compress silver 140 deposit due to the inward compressive force 162 exerted by fingers 44. Force 162 may be derived from the spring characteristics of fingers, for example, fingers 44 made from phosphor bronze or beryllium copper, or force 162 may be derived from an elastomer or a spring, such as a coil or flat metal spring, made for example, from phosphor bronze, beryllium copper or other preferably non-magnetic metal. As blade 36 proceeds deeper into fingers 44, ridges 146 become progressively higher and wider as seen in FIGS. 13, 14, 15 thereby progressively digging deeper into silver deposit 140 due to force 162. In this manner the silver 140 along any ridge 146 path is being progressively compressed thereby insuring excellent electrical contact over a large area during the entire period of insertion of blade 38 into fingers 44. Ridges 146 also serve to effectively increase the electrical contact area between finger 36 and blades 44.

In general, the inward force 162 exerted on blade 36 by fingers 44 will be comparable to or less than that employed in conventional finger and blade contact designs for comparably current rating. The compression of metal layer 140 will generally range from about 0.01 mm to 3 mm though greater layer 140 compression may be employed. At higher voltages and currents well-known arcing horns may prove beneficial in improving device performance.

Referring again to FIG. 2, conductive strip 20 segments 58 and 60 are propelled at high velocity toward fingers 44 and 46. Referring again to FIG. 16, the inward force 162 exerted by fingers 44 is preferably such that the energy of moving strips 58, 60 is absorbed in the deformation and compression of silver deposit 140 on blade 36 as it is engaged by fingers 44. This provides the highly desirable situation where the energy of movement of strips 58, 60 is progressively converted into a finger and blade insertion force thereby minimizing any momentum transfer from strips 58, 60 to the inner surface of transfer switch 21. Thus, the energy is dissipated in the deformation and compression of the compressible metal 140 while achieving the predetermined penetration of blade 36 into fingers 44. The forces employed for conventional finger and blade contacts engagement are generally manually or spring driven whereas in the present invention it is driven by exothermic means.

Referring again to FIG. 11, the thickness 164 of fingers 44 from the base 168 of ridges 146 to the opposing surface 167 remains substantially constant, but may be made variable to alter ridge 146 to silver deposit 140 contact characteristics. Ridge 146 height above base surface 168 starts at a small value 158 at the fingers 44 lip 148 and progressively increases to a predetermined height 160 at its termination. The rate of ridge height increase, from 158 to 160, may be varied for optimum electrical contact characteristics with the compressible silver deposit 140. Fingers 44 may have a suitably thin layer of hard silver plated thereon to enhance electrical properties and mechanical wear characteristics. When the compressible metal 140 is of copper or other metal than silver, a thin layer of silver may be deposited on its surface to enhance low resistivity contact and in some cases to improve resistance to oxidation.

Figure 17:
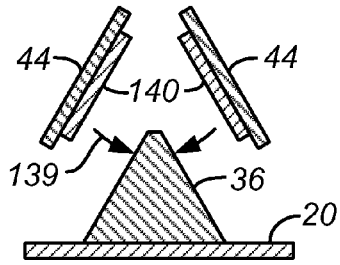
FIG. 17 is a cross section view of a wedge shaped finger contact with appropriately positioned blade contacts.

Referring now to FIG. 17, shown is the blade contact 36 of FIGS. 10 and 12 in the form of a wedge having a suitable angle 139. Fingers 44 are positioned at an angle similar to 139 to achieve proper contact mating. This enables full surface electrical contact of fingers 44 and blade 36 in the shortest possible time.

Figure 18:
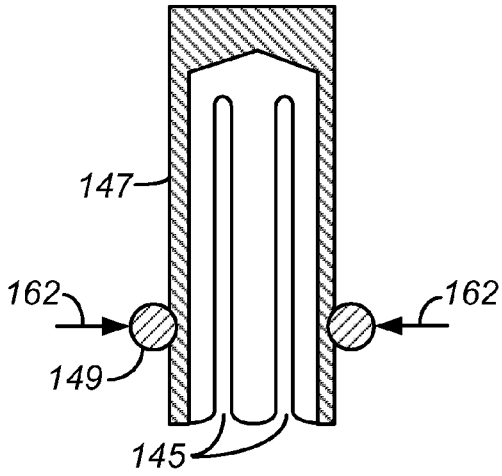
FIG. 18 is a front cross sections view of a slotted female circular sleeve contact.

Referring now to FIGS. 18, 19, 20, 21 shown is a circular cylindrical electrical contact herein referred to as rod and sleeve. FIG. 18 is a circular cylindrical hollow sleeve contact 147 having multiple slots 145 of predetermined length substantially parallel to the long axis and a wall of predetermined thickness. Severed spring 149, which girdles sleeve 147, nests in a circumferential groove in the outer periphery of sleeve 147. Spring 149, which may be phosphor bronze, expands and contracts in a substantially radial manner. Severed spring 149, which may be wire, flat or other suitable shape, provides inward radial force 162 to provide predetermined pressure against the male connect of FIG. 19. Copper has relatively poor spring characteristics but excellent electrical properties. A copper sleeve 143 with spring 149 is a preferred construction.

Figure 19:
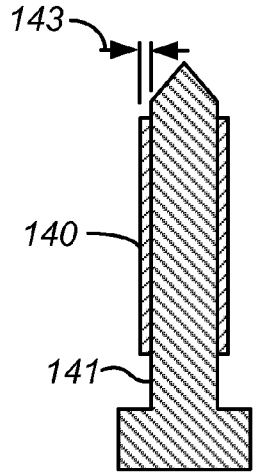
FIG. 19 is a front cross section view of a cylindrical male contact to mate with FIG. 18.

Referring now to FIG. 19, shown is a circular cylindrical male rod connector 141 for insertion into the female connector of FIG. 18. The outside diameter of rod 141 and the inside diameter of sleeve 143 (FIG. 18) are selected to provide predetermined mating characteristics for fit and pressure.

The surface of rod 141 may have a compressible thin layer of metal 140 deposited as described in FIGS. 10 and 12. Alternatively, the inside surface of sleeve 143 (FIG. 18) may have a thin layer of compressible metal deposited.

Figure 20:
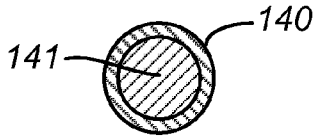
FIG. 20 is a top down cross section view of the male contact of FIG. 19.

Referring now to FIG. 20, shown is a cross section of a rod contact 141 and a thin compressible metal layer 140.

Figure 21:
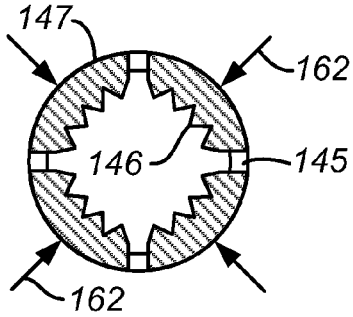
FIG. 21 is a top down cross section view of the female contact of FIG. 18.

Referring now to FIG. 21, shown is a cross section of a female sleeve connector 147 illustrating internal ridges 146, as described in FIGS. 11, 13, 14 and 15, and slots 145 and spring force 162 (FIG. 18).

Figure 22:
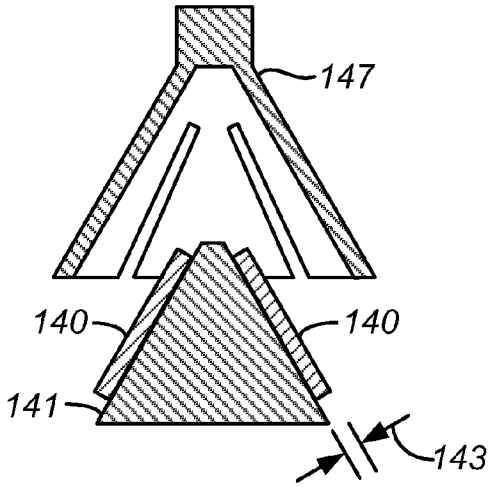
FIG. 22 is a front cross section view of a conically shaped male contact of FIG. 19, and a correspondingly conically shaped female connector of FIG. 18.

Referring now to FIG. 22, shown is the male rod contact 141 in a conical shape with a female sleeve contact 143 in a substantially corresponding conical shape. This enables fast, full face mating of the electrical contact surfaces.

Other geometrical shapes for rod and sleeve, which may require indexed insertion such as elliptical or star, may be employed. In general, the rod and sleeve class of connectors as described above are employed in high voltage applications wherein the rod and sleeve are encased in insulating material with tapered, generally conically shaped, mating surfaces. A common application is in high voltage medical x-ray machines.

Referring now to FIGS. 23 to 32, shown is the construction of preferred embodiments of superimposed metal strip strips 20, 170, 172 to illustrate the various steps of construction.

Figure 23:
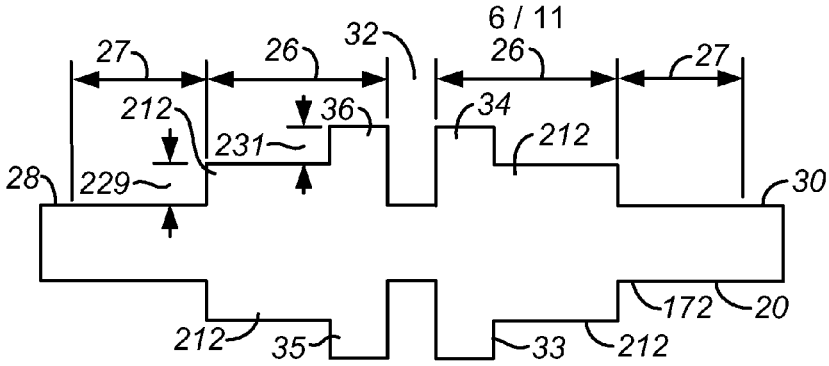
FIG. 23 is a top down view of a stamped conducting metal strip incorporating contacts and guide means.

Referring now to FIG. 23, shown is a top down view of a metal strip, here 172, as stamped from a sheet of metal such as copper. Other methods of manufacture include milling, EDM, electroforming and chemical milling. Metal strip 172 comprises input 28 and output 30, second section 27 which acts as a hinge or bending section, first section 26 with guide 212 and first input contacts 35, 36 and first output contacts 33, 34. As in FIG. 1, severance of strip 172 occurs in spacing 32.

Figure 24:
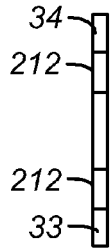
FIG. 24 is an end view of FIG. 23.

Referring now to FIG. 24, shown is an end of view of strip 172 of FIG. 23.

Figure 25:
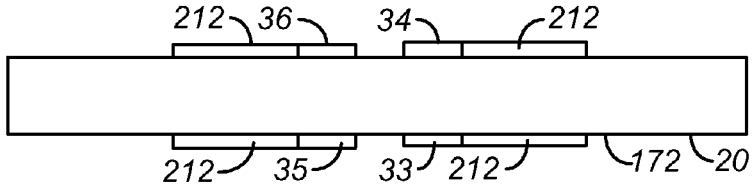
FIG. 25 is a top down view of FIG. 23 with contacts and guides bent at substantially ninety degrees to the surface of the strip.

Referring now to FIG. 25, shown are guides 212 and first contacts 33, 34, 35 and 36 bent at substantially ninety degrees with respect to strip surface 172 with the bending operation preferably providing substantially uniform surfaces and spacings.

Figure 26:
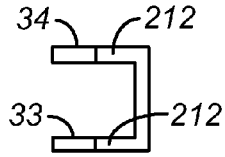
FIG. 26 is an end view of FIG. 25.

Referring now to FIG. 26, shown is an end view of FIG. 23 illustrating the uniform geometry resulting from the bending operations.

Figure 27:
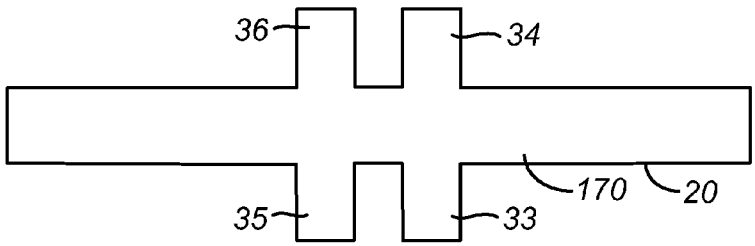
FIG. 27 is a top down view of a stamped strip having contacts only.

Referring now to FIG. 27, shown is stamped strip 170 having only first contacts 33, 34, 35, 36 and no guides 212, and the contacts are bent up (not shown) in the same manner as in FIG. 25.

Figure 28:
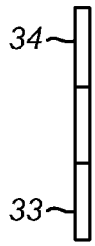
FIG. 28 is an end on view of FIG. 27.

Referring now to FIG. 28 shown is an end view of FIG. 27.

Figure 29:
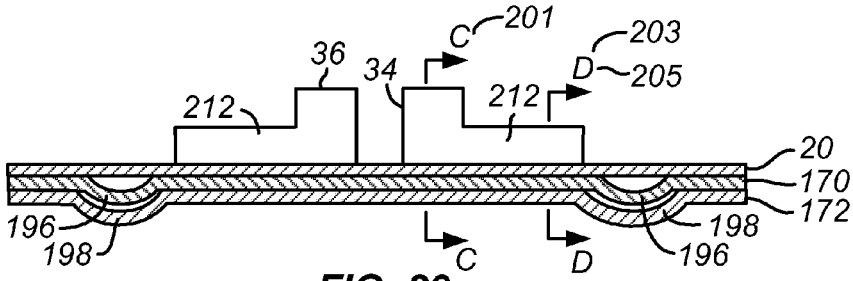
FIG. 29 is a front cross section view of three superimposed conducting strips with bent up guides, contacts and bending relief.

Referring now to FIG. 29, shown is a side cross section view of multiple superimposed strips 20, 170, 172. Though three strips are shown, more may be employed. At current levels approaching and exceeding the 1000 ampere range, superpositioning of strips is a desirable design approach. Second sections 27 of strips 170, 172 are geometrically deformed 196, 198 as will be fully described in FIG. 33. Cross section C-C 201 shows the adjoining first contacts 33, 34 of nested and superimposed strips 20, 170, 172. Cross section D-D illustrating guide 212 construction has two options, 203, 205.

Figure 30:
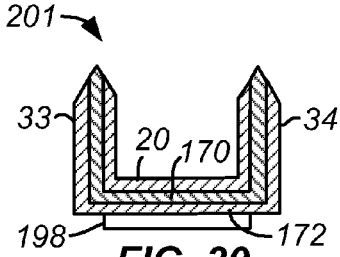
FIG. 30 is a cross section through the contacts of FIG. 29.

Referring now to FIG. 30, shown is cross section C-C 201 of FIG. 27. Shown are contacts 33 and 34. Contact 33 as shown comprises three adjoining contacts 33, one each from strip 20, 170 and 172. In like manner, contact 34 comprises three adjoining contacts 34, one each from strip 20, 170 and 172. The three adjoining contacts 33 are mechanically and electrically joined as a single contact 33, and in like manner, contacts 34 are joined. Joining may be by one of any of several different methods, such as brazing, soldering and thermo-compression bonding wherein a thin layer of suitable metal such as silver, is placed between adjoining contact surfaces and a suitable temperature and force is then applied, in a controlled atmosphere if necessary, to affect a bond. A sheet of metal powder in a binder may be employed. The leading edges of now integral contacts 33 and 34 may then be tapered.

Figure 31:
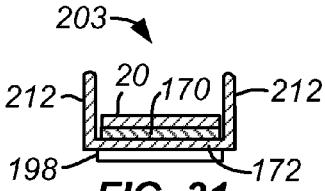
FIG. 31 is a first option cross section through the guides of FIG. 29.

Referring now to FIG. 31, shown is guide 212 cross section D-D 203. Here only one set of guides 212 per FIG. 23 are employed in strip 172. Strips 20, 170 have no guides per FIG. 27.

Figure 32:
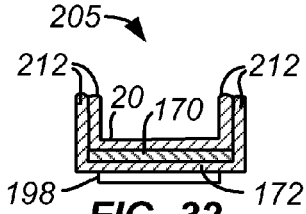
FIG. 32 is a second option cross section through the guides of FIG. 29.

Referring now to FIG. 32 cross section D-D 205, shown are the use of two sets of guides 212, one internal, strip 20, and one external, strip 172. The bottom strip, here 172, maintains the substantially coplanar construction of contacts 33, 34, 35 and 36, and guides 212 as shown in FIGS. 25, 26. However, the top strip 20, with multiple strips 170 intermediate strips 172 and 20, will have the plane of contacts 33, 34, 35, 36 displaced from the plane of the guides 212 substantially in proportion to the number of strips 170 intermediate strips 172 and 20. This is illustrated when comparing FIG. 30 with FIG. 32. In this manner, strip 20 guide 212 adjoins strip 172 guide 212. The guides may be bonded in the same manner as with contacts 33, 34 35 and 36. At current approaching the thousand ampere range and higher the construction of FIG. 32 may be preferred to maintain stability of the first sections during movement as they will be relatively massive and large.

The outer surfaces of contacts 33, 34, 35, 36 and guides 212 of strip 172 are in close proximity to the inner wall of the housing with the wall serving to maintain alignment of first and second contacts over at least the final path of travel of the first sections. The outer surfaces of contacts 33, 34, 35 and 36 may suffice for needed first and second contact alignment and thus all strips may be configured as in FIG. 27, that is, without guides 212.

The inner surfaces of guides 212 may also be employed for first and second contact alignment by incorporating a guide rail that confine the movement of guides 212 to a predetermined direction.

In the above embodiments, multiple strips of FIG. 27 geometry may be employed to substantially increase the strip count and therefore the current carrying capacity. With increasing strip count, and in order to provide proper nesting of the contacts, the spacing between contacts 33, 34, and 35 and 36 progressively increases. First section 29 incorporates guides 212 of height 229 and dual contacts 35, 36 and 33, 34 of height 231, where contact height 231 is generally greater than guide height 229. This embodiment provides two sets of contact each for the first input contact 35, 36 and first output contact 33, 34. With two sets of dual contacts the current load is reduced by about half in each contact thereby doubling the current load capacity for a given geometry. When the strip is to have multiple input contacts mounted, as illustrated in FIG. 4, modified guide sections 212 are incorporated between adjoining input contacts.

When bending a rectangular bar of thickness b around radius R, the inside radius of the bar is in compression and the outside radius is in tension. The force required to bend is proportional to the thickness squared, $b^2$. If two bars of half the thickness b/2, are bolted together at each end, it continues to act as a bar of thickness b with the required force again being $\sim b^2$. However, if the two bars of b/2 thickness are bolted together at only one end and bent over radius R, each bends independently of the other with the outer bar sliding over the inner bar in order to compensate for the increased radius of curvature R+b/2, at the bend. The required force is now reduced since each bar independently requires a force $\sim(b/2)^2$ or one quarter that of b. If the bar thickness is b/10, the force required is $\sim(b/10)^2$ or 1% that required for bar b thickness. If 10 bars are superimposed to return to a total thickness of b, the force increases ten times. That is, the total force F was reduced one hundred fold (0.01F) but is multiplied by 10 bars, which results in a net force reduction of ten (0.1F).

To achieve the desired force reduction and bolt both ends of multiple superimposed bars or strips, one may increasing geometrically deform each successive bar, for example, in the form of a curve, in the region of the hinge or bending region, here the second section. By way of illustrative example, circular arc segments are used to simplify calculations though any of a number of geometries may be beneficially employed. The progressively increasing arc lengths with each successive underlying strip compensates for the increase in arc radius R caused by each added bar thickness b/x where x is the reduced thickness corresponding to the number of strips. Each successive outward bar has a correspondingly greater arc length which is determined by the increasing radius, whereas, the innermost strip may be flat. The curvature of the arc may be any predetermined shape, such as circular, parabolic etc. The second bar has an arc length proportional to (R+b/x), the third bar (R+2b/x), the fourth (R+3b/x) and so on to the xth bar, e.g., 10 as in the example described. The arc length is determined by the angle through which the superimposed bars are bent. In this manner, within the region of the bend all bar surfaces substantially meet upon completion of the bend. Since each bar has bent independently of the adjoining bars, the desired bending force reduction is obtained while maintaining the benefits of having both ends of the superimposed bar bolted.

A further benefit of stacking multiple bars or conducting strips, as employed in the present invention, of b/x thickness is the ability to handle high frequency currents. The skin depth of current in a strip is determined by frequency. Below the skin depth little current is conducted and so the additional metal is wasted. Thus, for a given frequency of operation the optimum strip thickness is twice the skin depth, that is, one skin depth on each surface as in rectangular buss bar construction. By providing a thin layer of insulation on one surface of the strip adjoining another of the superimposed strips, each strip of b/x thickness effectively becomes an insulated current conduit with all x strips being electrically in parallel. Since there is essentially no voltage difference between strips the insulation may be quite thin, for example, 1 to 100 microns and may be of any suitable insulating material, which may also serve as an adhesive, such as epoxy, parylene, etc. which may be sprayed, dipped, brushed on or applied by any other means. In this manner, virtually any thickness b of strip 20 comprising multiple superimposed strips of thickness b/x, may be built up with assurance that excessive surface heating of strip 20 is avoided that is due to a rapid surge of current, i.e. high di/dt, or passage of a high frequency current.

Figure 33:
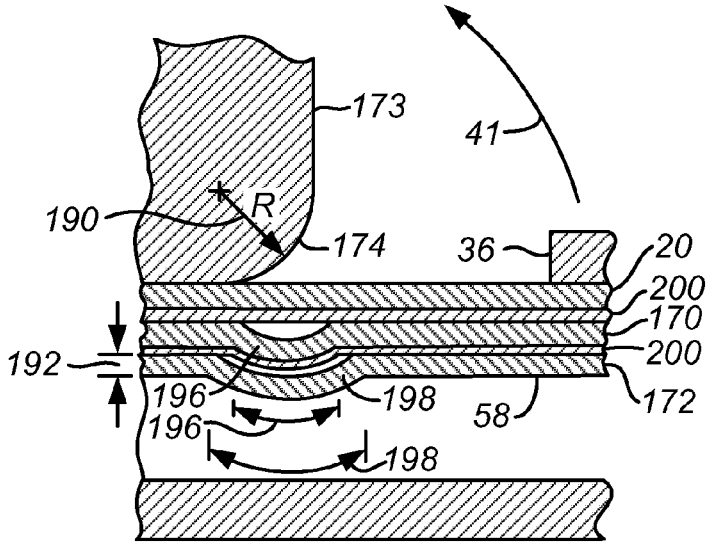
FIG. 33 is a partial cross section view of superimposed multiple metal strips having successively larger compensating clearance in the second or hinge segment of the metal strip, and thin insulation between metal strip layers for high frequency benefits.

Referring now to FIG. 33 shown is a partial cross sectional and segmented view of a transfer switch employing superimposed metal conducting strips 20, 170, 172, with 170,172 having deformed second sections which act as a hinge here shown as curved, which compensate for bending along curved bending surface 174 as described below. Three strips are shown but more may be employed. Curved segment 196 of strip 170 is designated 196, to illustrate its length. In like manner curved segment 198 of strip 172 is designated 198, to illustrate its greater length than curved segment 196. Strip 20 may remain substantially straight or may include a predetermined deformation. Strips 20, 170, 172 may have further deformation, such as a U or V shaped geometry, to compensate for thermal expansion of strips 20, 170, 172.

Guide rail 173 incorporates fixed curved surface 174 which provides the bending for superimposed strips 20, 170, 172, collectively called the strip or strip 20. It may be of any suitable shape, such as, circular, parabolic, etc. Curved surface 174, for illustrative purposes and simple calculations, will be a segment of a circle of radius R 190. Again for illustrative purposes, the bending angle will be 90 degrees, that is, one quarter of the circumference of a circle with the arc length therefore being $\pi R/2$. The thickness of each strip 20, 170,172 is (d) 192, previously discussed as b/x. Thus, as strip 20 bends over radius (R) 190, the outer surface radius becomes R+d. When strip 170 bends over strip 20 its outer surface has a radius of R+d+d or R+2d. In like manner, when strip 172 bends over strip 170, its outer surface has a radius of R+d+d+d or R+3d. Thus, the outer arc length 196 for strip 170 is greater than that for strip 20 by $\pi d/2$, and the outer arc length 198 for strip 172 is $\pi d$ greater. This allows for the "take-up" during the bending phase of segments 58, 60 (FIG. 2). Each strip 20,170,172 bends independently, thereby substantially reducing the required force as previously described. Strips 20, 170, 172 are joined by the bonding of contacts 33, 34, 35 and 36 as previously described (FIG. 30). Further bonding is achieved when guides 212 of strips 20 and 172 are bonded (FIG. 32). This provides the first sections of segments 58 and 60 with a relatively rigid (stiff) structure. For additional stiffness, periodically placed rivets binding strips 20, 170, 172 together may be employed.

To enhance the high frequency characteristics, especially at high currents where multiple strips may be required, a very thin layer of insulation 200, such as shellac, epoxy, parylene etc, may be applied to at least one of the opposing surfaces of an adjoining strip inasmuch as there is essentially no voltage between strips. In this manner, strips 20, 170 and 172 act as parallel strips each having its own skin depth of current. Thus, during high transient currents or passage of high frequency currents, surface heating of the strips due to shallow current skin depths is minimized.

Figure 34:
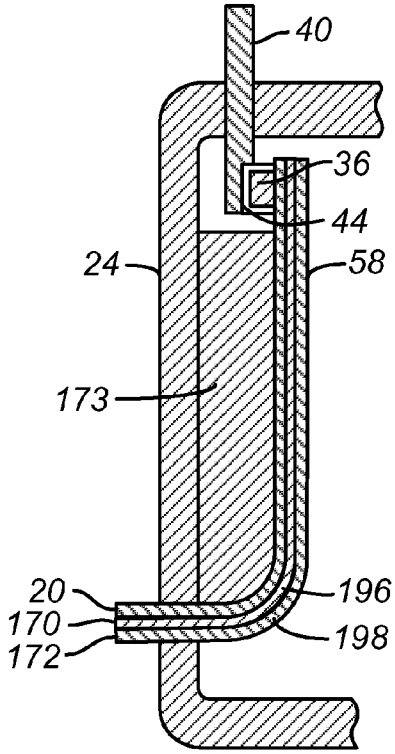
FIG. 34 represents FIG. 33 after exothermic cutting and propulsion of a conducting strip segment into engagement of respective input and output contacts illustrating take-up of the curved hinge segments.

Referring now to FIG. 34, shown is strip segment 58 in its final position having traversed its 90 degree arc with its blade 36 having engaged fingers 44 of second contact 40. The added arc lengths of curved segments 196 and 198 are "used up" and the opposing surfaces of strips 20, 170, 172 are in close proximity to each other. In general, it is desirable to make the length of arc segments 196 and 198 (FIG. 33) slightly longer than necessary such that in its final position there is still a small gap between the adjoining surfaces of 20 and 170 and 170 and 172 to allow for any error in dimensioning of strips 20, 170,172. The geometry at segment 60 is substantially identical.

Conducting strips 20, 170, 172 are designed to have low resistance and at operating currents have low power dissipation. This results in a small temperature rise above ambient with a corresponding very low expansion of the strips. For example, employing conducting strip lengths of 10 inches, as might be used in a 38 kV distribution voltage transfer switch, a 24° C. (43° F.) temperature rise over ambient results in a 0.1 mm (0.004 inch) expansion of the strips less than the thickness of a human hair. Copper, having a high thermal conductivity, rapidly conducts heat though both ends of the conducting strips to the bus bars to which they are connected and thus the temperature is averaged. The temperature in the center of the strips will be higher.

The housing, to which the strips are tied to at both ends, is generally composed of plastic which has a higher coefficient of expansion than the strip metal, usually copper. Heat from the strips by conducted and by convection of the housing gas fill increases the housing temperature by a lesser amount than the strip temperature rise. However, the higher expansion coefficient of the housing largely compensates for the strip to housing temperature difference.

If needed, one method for compensating any strips to housing differential expansion is to provide a small degree of resiliency to at least one of the walls of the housing through which the strips pass.

Figure 35:
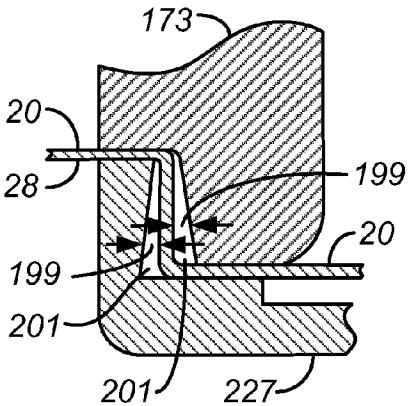
FIG. 35 is a partial cross section view of a conductive strip provided with a thermal expansion relief geometry.

Referring now to FIG. 35, shown is a partial cross section view of a conducting strip prepared with a thermal expansion joint. Strip 20 after passing through the wall of housing 227 is bent at a suitable angle, preferably 90 degrees, and after a suitable distance is again bent at about 90 degrees. The lower surface of guide rail 173 opposing strip 20 and the upper surface of housing 227 opposing strip 20 are both in close proximity providing only sufficient clearance for movement of strip 20 to compensate for expansion. Spaces 201 having suitable dimensions 199 to enable any needed movement of strip 20 to compensate for expansion. Strip 20 expansion is quite small, for example, 0.1 mm (0.004 inches), or less. Therefore, spacings 199 may be quite small. In general, only one end of strip 20 need have expansion relief while the other end is locked firmly in place.

Figure 36:
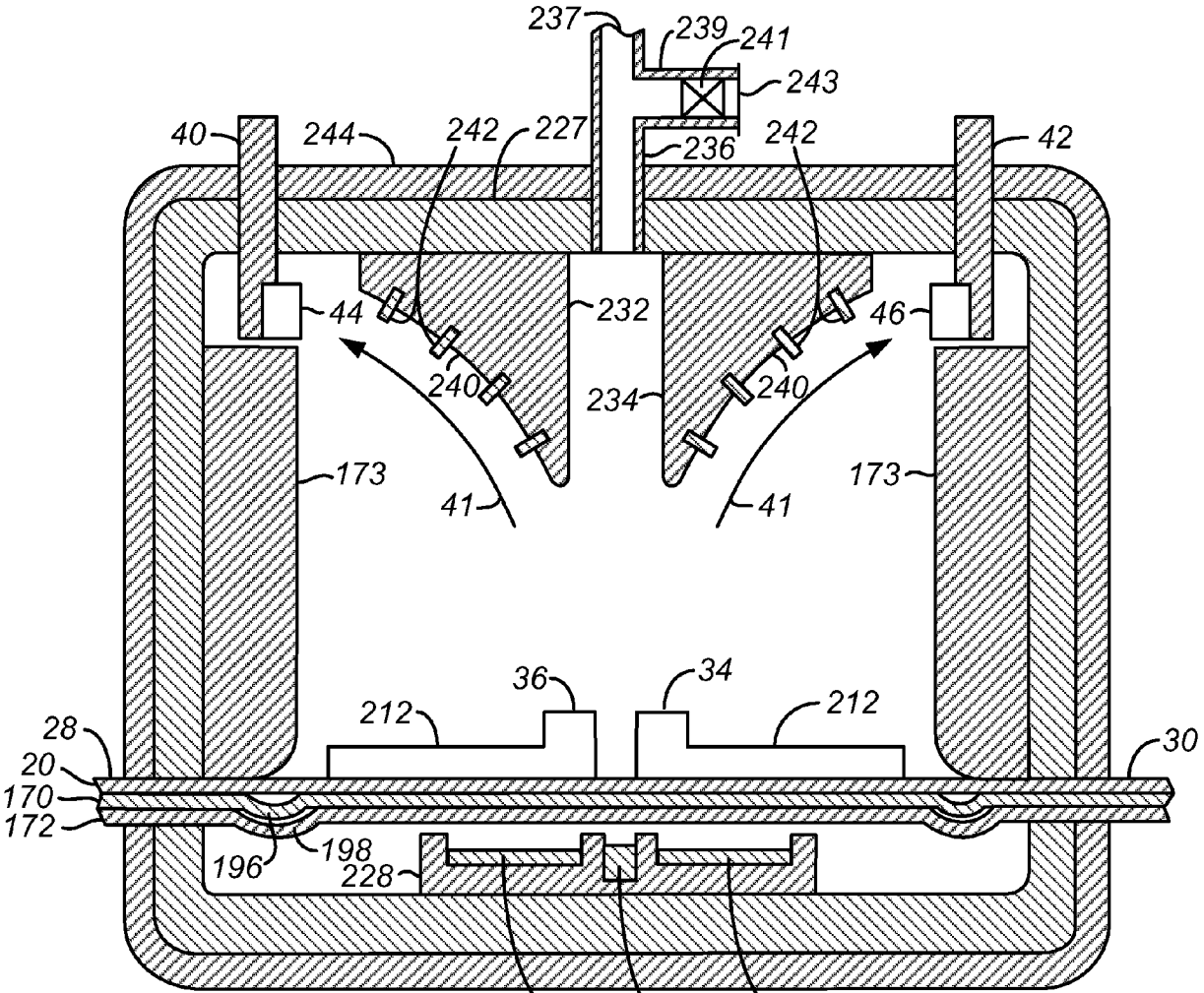
FIG. 36 is a front cross section view of a preferred embodiment of the present invention.

A preferred embodiment of the present invention in a side cross section view is shown in FIG. 36, and by way of example, employs multiple superimposed strip and contact configuration of FIG. 33. The superimposed strip strips 20, 170, 172 and shown first contacts 36, 34 are as previously described. Second contacts 44, 46 are shown. Not shown are first contacts 33, 35 and second contacts 43, 35 which are the mating second contacts for first contacts 33, 35. For high voltage and/or high current use, arcing horns which are well-known, may be incorporated near finger contacts 44, 46.

Exothermic cutting source 52 holder 228, generally made from ceramic such as alumina, has been modified to accept exothermic propulsion sources 220. Propulsion sources 220 are positioned beneath what will become strip 20 segments 58 and 60 upon ignition of cutting source 52 and subsequent bifurcation of strip 20. Strip 20 incorporates strips 20, 170 and 172. Propulsion sources 220 may be ignited subsequent to ignition of 52, or a fuse element may connect 52 to 220. Exothermic cutting charge 52 bifurcates strip 20 intermediate contacts 34, 36 in region 32. Sources 220 may be shaped to provide a preferably uniform force along at least part of the under surface of segments 58, 60. The amount of propulsion material 220 employed is designed to achieve the predetermined blade contact 36, 34 penetration into fingers 44, 46, as well s for the contacts not shown, 33, 35 and 43, 45. For illustration purposes, the path of travel 41 of strip 20 segments 58, 60 (per FIG. 2) toward second contacts 44, 46 is shown.

Referring again to FIG. 36, shown are splatter shields 232, 234, which serve to trap between them much of the metal evaporated when cutting source 52 burns through superimposed strip 20. The directed force of the hot cutting gases is primarily straight up and may be assisted in that purpose by shaping the cavity in holder 228 in which source 52 sits. Shields 232, 234 made of a suitable insulating material such as plastic or ceramic, also increase the electrical isolation path between contacts 44 and 46. Shields 232, 234 may extend the full internal width of switch housing 227 and are in proximity to the path of travel 41 of segments 58, 60. The shields may also be periodically slotted to a predetermined depth, and angled away from the center of the housing 227 such that evaporated metal does not enter the slots. This can increase the surface breakdown voltage significantly. Particularly when the inside walls of housing 227 are also slotted to a predetermined depth and angled so as to prevent entry of evaporated metal. The slots would, in general, be orthogonal to the axis of guide rail 173, that is, perpendicular to the surface of the drawing.

At very high current levels, arc energy levels can be high with consequent heat damage to housing 227 when it is made of plastic. Alternatively, housing 227 internal dielectric surfaces can be made from dielectric materials made from high temperature resistant materials such as ceramic. For example, Alumina ceramic is a preferred choice. Shields 232, 234 may have a modified shape as shown with curved surfaces 240 that approximate the path of moving strip 20 segments 58 and 60 (refer to FIG. 2) and that are in close proximity to the paths of moving contacts 34, 36. Curved surfaces 240 of shields 232, 234 may have mounted, and suitably spaced, cold cathode plates 242, made of iron or other suitable magnetic material. Cold cathode plates are used extensively in circuit breakers, and are well known. They serve to help absorb arc energy and serve the same purpose here. Alternatively, insulated plate arc chutes may be employed.

With housing 227 made of, for example, ceramic, a suitable encapsulation 244 of housing 227 is desirable to affect a hermetic seal and to provide strength. Encapsulant 244 is of dielectric material, for example, a suitable plastic such as epoxy. Alternatively, encapsulating material, 244 may be epoxy—fiber glass with the fiber glass, for example, wrapped around housing 227 and impregnated with epoxy or other suitable plastic to effect, upon curing, a hermetic seal. Construction may be in the manner of fiber glass boats. Contacts 28, 30, 44, 46 and tabulation 236 protrude through hermetic encapsulating shell 244.

Referring again to FIG. 36, the side wall of housings 227 and 244 may be spaced apart to provide additional volume for expansion of the heated gases due to the exothermic reaction. The inner wall of 227 provides the guide surfaces for to align guides 212 and contacts 33, 34, 35, 36 with their respective second contacts. Spaced apart vertical risers may be provided for additional supports between the outer wall of 227 and the inner wall of 244.

Referring again to FIG. 36, tubing 236, preferably of compressible copper, is molded integrally into switch housing 244, 227. The copper tubing may be equipped with a tubing arm in a "T" shape with arm 239 incorporating a relief valve 241 such that should excessive pressures develop within housing 227 upon exothermic ignition, the pressure can be relived down to a predetermined pressure level before resealing. Assembly of the switch involves a vacuum exhaust through tubing at 237 and processing. The evacuated housing is backfilled with a suitable gas, such as sulfur hexafluoride which has a dielectric strength of 70 kV/cm at one atmosphere (absolute), and about 120 kV/cm at 2.5 atmospheres (absolute) or dry nitrogen. This enables relatively compact designs. Upon completion of dielectric gas backfill, the copper tubing is pinched off by standard technique thereby forming a hermetic seal. Housing 227 is hermetically tight. With consumed switches, the dielectric gas may be recovered with standard refrigeration gas recovery technique and equipment.

Figure 37:
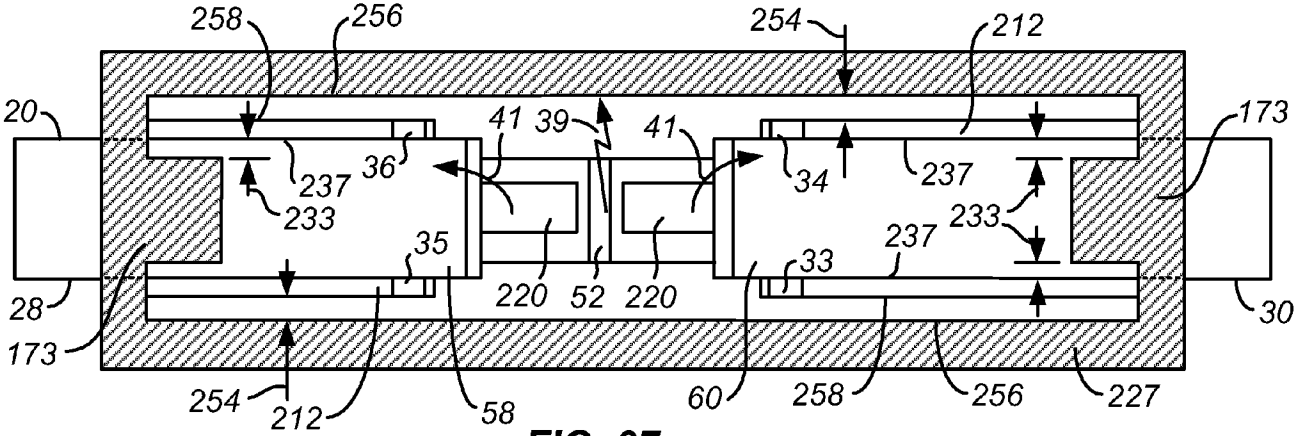
FIG. 37 is a top down cross section view of the transfer switch illustrating the segmented metal strip guide structure as the metal strips are propelled toward the second contacts to form the second electrical connection.
Figure 38:
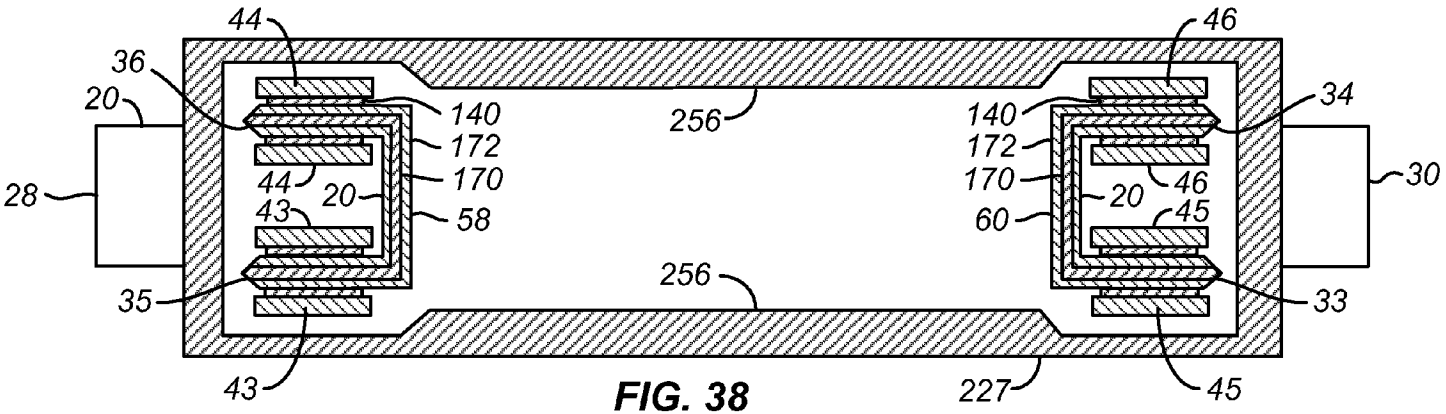
FIG. 38 is a top down cross section view of FIG. 36 through the first and second contacts upon mating of the first and second contacts.

Referring now to FIG. 37, shown is a cross section top down view of FIG. 36 illustrating propulsion of segments 58 and 60, and their first contacts, 33, 34 and 35, 36 on their path of travel 41 towards engagement with the second contacts (not shown). Strip 20 segments 58 and 60 are seen in flight after severance by exothermic cutting source 52 and being propelled 41 by exothermic propulsion sources 220 toward engagement with respective second contacts not shown). Segments 58 and 60 are moving rapidly and it is important that proper alignment between the moving first contacts and stationary second contacts be maintained to obtain predetermined mating characteristics.

With superimposed strips 20, 170, 172, bottom strip 172, when provided with guides 212, has the external surfaces 258 of guides 212 and first contacts 33, 34, 35, 36 in a coplanar configuration. That is, they constitute a planar surface as shown in FIGS. 25, 26. the inside walls 256 of housing 227 are in close proximity 254 to strip 172 outside surfaces 258 of guides 212 and contacts 33, 34, 35 and 36. Spacing 254 may, for example, range from 0.05 mm to 4 mm with 0.2 mm to 1 mm being a preferred range thereby maintaining control of the movement of segments 58, and 60. The inside wall 256 construction of housing 227 may accommodate spacing 254 selectively, for example, spacing 254 may only trace all or part of the path of travel 41 of the external surfaces of the guide 212 and contacts 33, 34, 35.36.

Referring again to FIG. 37, a further method of contact alignment comprises employing guide rail 173 which is constructed with two narrow grooves 235 into which guides 212 fit, and which may be integral with a wall of housing 227. In this configuration the inside surface 237 of guides 212 are in close proximity to the sidewalls of rail 173. Spacings 233 may also range from 0.05 mm to 4 mm with a preferred spacing being from 0.2 mm to 1 mm. Shown here is a single guide 212 as in FIG. 29. For large high current superimposed strip structures, the dual guide 212 of FIG. 32 may be employed for greater strength.

Upon severance of strip 20 and propulsion of segments 58 and 60 toward the second contacts, guides 212 enter slots 235 and are guided in their path by the close proximity 233 of the inner surfaces 237 of guides 212 to the side walls of guide rail 173. Rails 173 and housing wall guide surfaces 256 do not extend all the way to second contacts 43, 44, 45, 46. For large transfer switches, it may be advantageous to employ both the guide rail and inside housing wall alignment methods.

Referring now to FIG. 37, shown is a top down cross section view through mated first and second contacts. First and second contacts have mated upon completion of the travel of strip 20 segments 58 and 60. First contact geometry is as shown in FIG. 30. First input blade contact 36 is mated with second input fingers contacts 44 and first input blade contact 35 is mated with second input fingers contacts 43. Blades 35 and 36 are electrically common, and fingers 43 and 44 are made electrically common at connector 40 (FIG. 3). Input 20 is now connected to second input connector 40 (FIG. 3). In like manner, first output blade contact 34 is mated with second output fingers 46, and first output blade contact 33 is mated with second output fingers 45. Blades 33, 34 are electrically common and fingers 45, 46 are mechanically and electrically joined to connector 42. Output 30 is now connected to second output connector 42 (FIG. 3).

The present invention provides the further benefit in that it can provide a puffer arc extinguishing action. This occurs when strip 20 segments 58, 60 are propelled toward contacts 44, 46. Segments 58, 60 compress the gas, such as dry nitrogen or sulfur hexafluoride, in front of it creating a high pressure region whereas behind segments 58, 60, there is a corresponding low pressure region. As first contacts 33, 34, 35, 36 are engaging second contacts 43, 44, 45, 46 the high pressure build-up relieves itself by exhausting at high velocity over contacts 43, 44, 45, 46 thereby helping to "blow out" the arc.

Fuses, as are presently employed in circuits, are installed in series in circuits, and, with a few exceptions, conduct the full load current of the circuit in which they are installed. As a result, fuses run hot which can result in nuisance blows due to cycling and surge currents. The few exceptions conduct some current. The fuse link melts and interrupts (breaks) the circuit when the conducted current (fault current) exceeds the fuse rating by a predetermined percentage. Fuse operating characteristics are affected by ambient temperature changes. The shortest possible fuse clearing time is desired in order to minimize possible damage to equipment and danger to personnel.

When fuses are incorporated into the present invention, they are employed in a novel manner. The fuse is not connected in series in the load current carrying strip. The fuse conducts no current until called upon to interrupt (break) the circuit. The fuse is therefore at ambient temperature and is not subject to nuisance blows which result from running hot. Fuse operation is caused by transfer switch action which is done by remote command and is independent of fault current. Wide ambient temperature changes have minimal effect on fuse performance.

Figure 39:
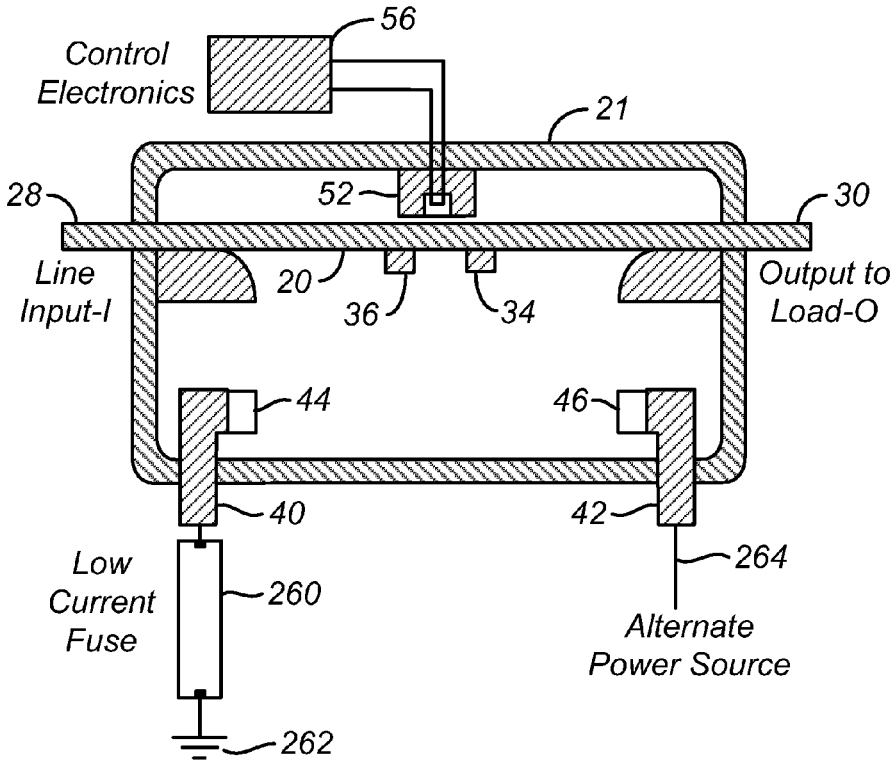
FIG. 39 is the transfer switch configured for switching the load to a second power source upon, for example, failure or overload of the input power source, and a fast fuse employed at the input connection for fast isolation of the input line.
Figure 40:
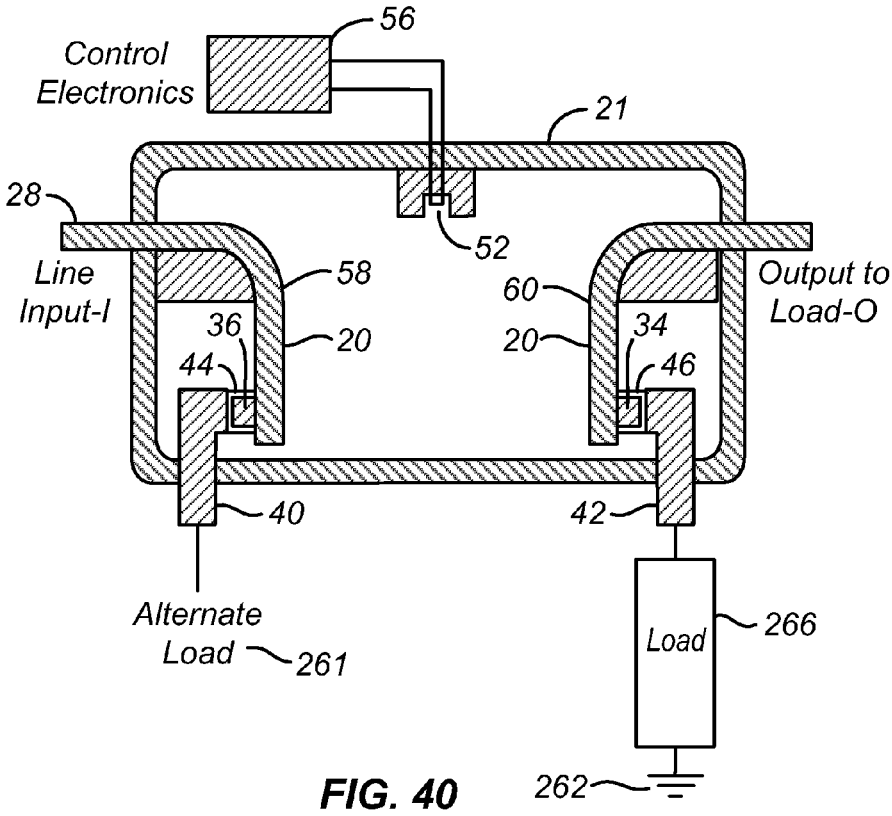
FIG. 40 is the transfer switch configured for load shedding upon a failure on the load side, and the input power is transferred to an alternate load.
Figure 41:
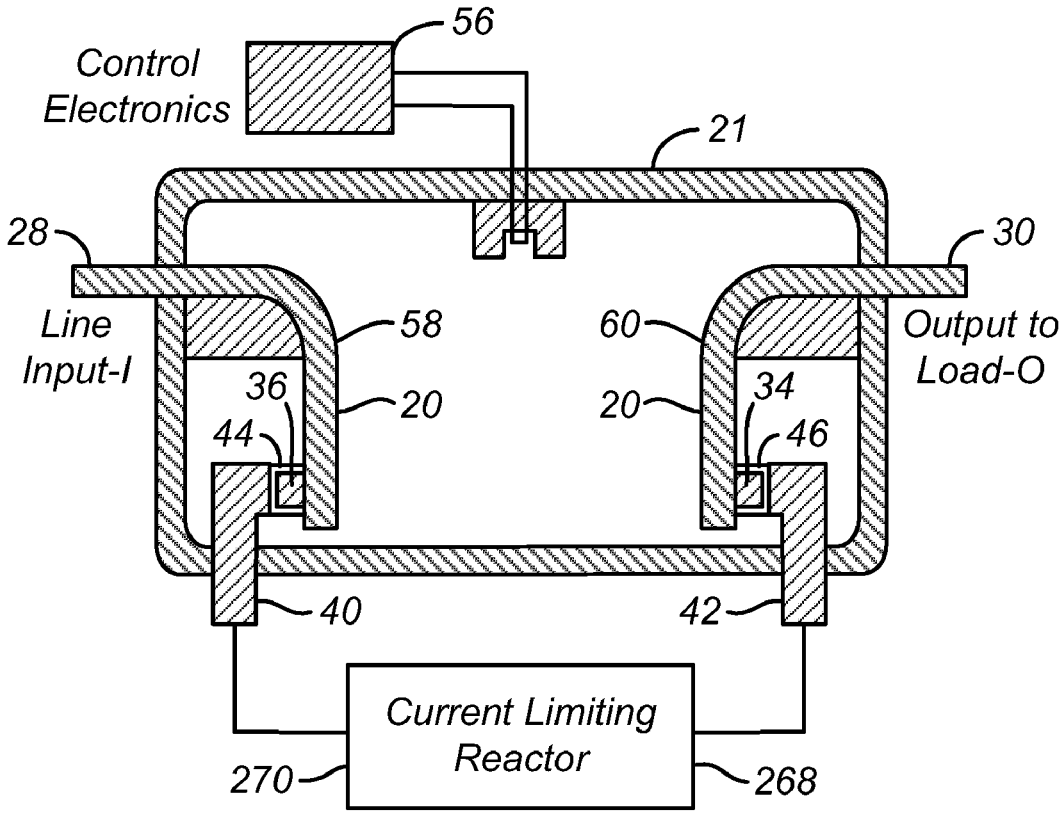
FIG. 41 is the transfer switch configured for system current limiting.

FIGS. 39, 40 and 41 illustrate the present invention configured for several system applications. For simplicity of description and illustration, the geometries of FIGS. 1 and 3 will be employed.

Referring now to FIG. 39, shown is transfer switch 21 in its normal operational mode with current flowing through strip 20 from input 28 to output 30 and thence to its assigned load. Input second contact 40 is connected to low current fuse 260 which in turn is connected to ground 262. Alternatively, to control current flow, a suitable load (not shown) may be connected between 40 and 260 and/or between 260 and 262. Output second contact 42 is shown, for illustration purposes, connected to an second power source.

Though fuse 260 may be of any current rating, as long as it meets the required voltage and short circuit current ratings, the lowest practical current rating is preferred. At very high currents fuses operate extremely rapidly. Typically, at about ten times rated current, clearance times of a few milliseconds are obtained. Thus, a 5 A rated fuse requires 50 A fault current to clear in a few milliseconds whereas a 500 A fuse requires at least 5000 A of fault current to clear as fast. Lesser fault currents require progressively longer to clear, often tens of seconds, depending on the time/current curve for that fuse. Clearly, the faster a fault is cleared, the less the potential damage to equipment and danger to personnel.

As can be seen in FIG. 39, in normal operation, contact 40 and therefore, fuse 260 are disconnected from current carrying strip 20. Since fuse 260 does not carry current in normal operation, it is at ambient temperature and, therefore not subject to the nuisance blows of fuses in normal use, i.e. carrying the full load current. Typically, nuisance blows result from repeated cycling, current surges etc. Therefore, the lower the current rating of fuse 260, the greater is the fault current range over which the fastest clearing time of a few milliseconds can be obtained.

Referring now to FIG. 40, shown is strip 20 having been bifurcated by exothermic source 52 into segments 58, 60 and propelled to engage contacts 44, 46 as described in FIGS. 2 and 3. Input 28 is now connected to an alternate load 261 through second input connection 40. Output 30 is now connected to load 266 through second output connection 42. Prompt load shedding through energy dump 266 may be required in case of a fault in the load. The input power is substantially simultaneously transferred to an alternate load 261. Alternatively, contact 40 may be configured with the fuse 260 of FIG. 39 to disconnect the input.

Referring now to FIG. 41, shown is transfer switch 21 configured as a fault current limiter wherein a current limiting reactor 268 or other suitable load is connected between contacts 40 and 42. The fast transfer switch quickly inserts reactor 268 into the load line which then limits the fault current to within the rating of normal protective devices such as circuit breakers. This eliminates reactor losses during normal operation.

Referring again to FIG. 41, transfer switch 21 may be configured as a system stabilizer to prevent power instability by replacing reactor 268 between contacts 40 and 42 with a damping device 270 such as a dynamic brake or power system stabilizer.

What is claimed is:

1. An electrical transfer switch comprising:

a housing, a conductive metal strip that extends through said housing, said conductive strip comprising a first end and a second end, said first and second ends positioned external said housing for a first electrical connection, said conductive strip further comprising:

at least one first section which severs upon predetermined conditions, thereby terminating the first electrical connection, at least one second section of said metal strip, distanced from said first section, at least one first electrical contact at said first section of said metal strip, at least one second electrical contact, a portion of said second contact extending through said housing for a second electrical connection, at least one exothermic source that upon ignition severs said metal strip at said first section and causes at least one segment of said severed metal strip to be propelled about said second section with subsequent engagement of said first electrical contact with said second electrical contact.

2. An electrical transfer switch in accordance with claim 1 wherein said exothermic source is positioned adjacent said metal strip first section.

3. An electrical transfer switch in accordance with claim 1 further comprising at least one metal tube extending from within said housing through a wall of said housing, a portion of said tube sealed to a wall of said housing.

4. An electrical transfer switch in accordance with claim 1 wherein said conductive strip comprises multiple superimposed sub-strips and a first section of each said superimposed metal sub-strips each having at least one first sub-strip contact, each said first sub-strip contact nested within and adjoining each succeeding underlying first sub-strip contacts, and adjoined first sub-strip contacts are electrically and mechanically joined to form a single contact, and each said sub-strip further comprises a second sub-strip section configured to be geometrically deformed, and each sequential underlying second sub-strip section having a greater length than the immediately above second sub-strip section.

5. An electrical transfer switch in accordance with claim 4 comprising an insulator on at least one surface of said metal strips.

6. An electrical transfer switch in accordance with claim 4 wherein said deformed second sub-strip section is curved.

7. An electrical transfer switch in accordance with claim 1 comprising at least two spaced apart said first electrical contacts, and said exothermic source is intermediate said first contacts, said switch further comprising at least two said second electrical contacts and space between an inner wall of said housing and an outer surface of at least one of said first contacts in a path of travel of said first section.

8. An electrical transfer switch in accordance with claim 1 comprising three spaced apart said first electrical contacts, and at least two said exothermic sources with at least one exothermic source intermediate a pair of said first contacts, said switch further comprising four said second electrical contacts.

9. An electrical transfer switch in accordance with claim 1 further comprising at least one guide for said first section.

10. A transfer switch in accordance with claim 9 wherein at least one external surface of said guide and said first contact are in close proximity to an inside surface of said housing along a predetermined length of a path of travel of said first sections.

11. An electrical transfer switch in accordance with claim 9 further comprising at least one guide rail of insulating material in a path of travel of said first section.

12. An electrical transfer switch in accordance with claim 1 comprising a space between an inner wall of said housing and at least one outer surface of said first contact in a path of travel of said first section.

13. An electrical transfer switch in accordance with claim 1 further comprising at least one shaped insulating splatter shield opposing said metal strip, said splatter shield spaced in proximity to the path of travel of said first section.

14. An electrical transfer switch in accordance with claim 13 wherein said splatter shield is configured with an arc chute, and wherein said arc chute is at least one of a cold cathode plate, an insulated plate, and a combination cold cathode plate and insulated plate.

15. An electrical transfer switch in accordance with claim 1 wherein inner walls of said housing are at least partially lined with at least one of a suitable ceramic and a high temperature electrical insulating material.

16. An electrical transfer switch in accordance with claim 1 wherein said conductive strip is connected in series with another transfer switch, and said second contact is connected to at least one of a fuse, predetermined energy dissipating load, current limiter, alternate power source, alternate load, and load stabilizer.

17. An electrical transfer switch in accordance with claim 1 wherein said second contact is connected to at least one of a fuse, predetermined energy dissipating load, current limiter, alternate power source, alternate load, and load stabilizer.

18. An electrical transfer switch in accordance with claim 1 wherein said exothermic source employs a severed electrical circuit and an arc to ignite said source.

19. An electrical transfer switch in accordance with claim 1 wherein said exothermic source comprises at least one exothermic metal cutting source and at least one exothermic propulsion source.

20. A transfer switch in accordance with claim 1 wherein at least one surface of at least one of said first and second electrical contacts has a layer of metal mechanically and electrically integral with said contact surface, said metal layer having a predetermined compressibility and a thickness of no less than 0.02 mm and no thicker than 6 mm.

21. A transfer switch in accordance with claim 20 wherein said metal layer comprises at least one of silver, copper, tin, gold, zinc, and non-ferrous metal.

22. A transfer switch in accordance with claim 20 wherein said metal layer is deposited on said surface by at least one of electro-plating, flame spraying, thermal spraying, arc spraying, plasma spraying, and thermo-compression bonding of a sheet of powdered metal in a binder.

23. A transfer switch in accordance with claim 22 wherein said metal layer is sintered under controlled conditions including at least one of elevated temperature, a controlled atmosphere, and mechanical pressure.

24. A transfer switch in accordance with claim 20 wherein said first and second input and output contacts have a finger and blade configuration, and wherein at least one surface of at least one of said finger and blade contacts has a metal layer of predetermined compressibility covering a predetermined area of said contacts.

25. An electrical transfer switch in accordance with claim 1 wherein said first and second contacts have a finger and blade configuration.

26. An electrical transfer switch in accordance with claim 1 wherein said second contact is connected to at least one of a fuse, predetermined energy dissipating load, current limiter, alternate power source, alternate load, and load stabilizer.

27. An electrical transfer switch in accordance with claim 1 wherein said first contact and said second contact are positioned such that when said first contact forms a circuit with said second contact, respective electrical contact surfaces of said first and said second contacts are substantially flush with each other.

28. An electrical transfer switch in accordance with claim 1 comprising at least one metal tube partially within said housing, and passing through and sealed to a wall of said housing, and protruding past said wall of said housing, said tube having at least one of an orifice for exhaust purposes and a tubing arm containing a pressure relief valve.

29. An electrical transfer switch in accordance with claim 20 wherein when said first contact forms a circuit with said second contact, compression of said metal layer is no less than 0.01 mm and no more than 4 mm.

30. A transfer switch comprising:

a housing, multiple current carrying strips of metal enclosed in said housing, at least one first section of said metal strips for severing upon predetermined conditions, at least one second section of said metal strips, distanced from said first sections, said first sections each having at least one first input contact and at least one first output contact, at least one second input contact and second output contact within said housing, a portion of said second input contact and a portion of said second output contact extending through and beyond said housing wall, at least one metal tube partially within said housing, a portion of said tube passing through and sealed to a wall of said housing, and protruding past said wall of said housing, at least one exothermic source adjacent said first sections of said metal strips such that upon ignition of said exothermic source, said metal strips are severed and said first sections of said metal strips are propelled about said second sections whereupon said first input contact engages said second input contact and said first output contact engages said second output contact.

31. A transfer switch of claim 30 wherein at least one surface of said metal strips is coated with an insulator.

32. A transfer switch in accordance with claim 30 further comprising said housing including at least one shaped insulating splatter shield, said splatter shield spaced from a path of travel of said first section and said splatter shield is configured with at least one of a cold cathode arc chute, an insulator plate arc chute, and both a cold cathode plate arc chute and insulated plate arc chute.

33. A transfer switch in accordance with claim 30 wherein said tube comprises a tubing arm containing a relief valve that opens at a predetermined pressure.

34. A transfer switch in accordance with claim 30 wherein said second input and output contacts are connected to at least one of a fuse, predetermined energy dissipating load, current limiter, alternate power source, alternate load, and load stabilizer.

35. A transfer switch in accordance with claim 30 wherein said exothermic source comprises at least one exothermic metal cutting source and at least one exothermic propulsion source.

* * * * *